US010946540B2

(12) United States Patent
Bozikis et al.

(10) Patent No.: US 10,946,540 B2
(45) Date of Patent: Mar. 16, 2021

(54) SHAVING RAZORS AND SHAVING CARTRIDGES

(71) Applicant: BIC-VIOLEX S.A., Anixi (GR)

(72) Inventors: Ioannis Bozikis, Koukaki-Athens (GR); Spiros Gratsias, Kipseli-Athens (GR); Christoforos-Athanasios Brellis, Neapoli-Athens (GR); Panagiotis Moustakas, Petroupoli-Athens (GR)

(73) Assignee: BIC-VIOLEX SA, Anixi (GR)

( * ) Notice: Subject to any disclaimer, the term of this patent is extended or adjusted under 35 U.S.C. 154(b) by 0 days.

(21) Appl. No.: 15/775,530

(22) PCT Filed: May 25, 2016

(86) PCT No.: PCT/EP2016/061854
§ 371 (c)(1),
(2) Date: May 11, 2018

(87) PCT Pub. No.: WO2017/092881
PCT Pub. Date: Jun. 8, 2017

(65) Prior Publication Data

US 2018/0361604 A1 Dec. 20, 2018

Related U.S. Application Data

(63) Continuation-in-part of application No. 14/964,745, filed on Dec. 10, 2015, now Pat. No. 9,539,734.
(Continued)

(51) Int. Cl.

| | |
|---|---|
| ***B26B 21/40*** | (2006.01) |
| ***B26B 21/22*** | (2006.01) |
| *B26B 21/44* | (2006.01) |

(52) U.S. Cl.
CPC ..... *B26B 21/4012* (2013.01); *B26B 21/227* (2013.01); *B26B 21/4018* (2013.01);
(Continued)

(58) Field of Classification Search
CPC ..... B26B 21/4012; B26B 21/4025; B26B 21/443; B26B 21/227; B26B 21/4018;
(Continued)

(56) References Cited

U.S. PATENT DOCUMENTS 1,822,379 A * 9/1931 Scully ..... B26B 21/18 30/73
2,871,561 A * 2/1959 Gavrin ..... B26B 21/18 30/65
(Continued)

FOREIGN PATENT DOCUMENTS

DE 855 972 11/1952
WO 88/07443 A1 10/1988
(Continued)

OTHER PUBLICATIONS

International Search Report for PCT/EP2016/061854 dated Oct. 14, 2016.

*Primary Examiner* — Ghassem Alie
(74) *Attorney, Agent, or Firm* — Polsinelli PC

(57) ABSTRACT

A retainer is provided that secures at least one blade within a housing of a shaving blade cartridge. The retainer extends along a pair of side edges of the housing between a front edge of the housing and a rear edge of the housing. The retainer includes an upper end portion and a lower end
(Continued)

portion. The lower end portion is connected to the upper end portion by an intermediate portion. The upper end portion includes an edge extending between opposing side edges. The edge includes at least one leg depending therefrom.

10 Claims, 16 Drawing Sheets

Related U.S. Application Data

(60) Provisional application No. 62/261,389, filed on Dec. 1, 2015, provisional application No. 62/271,571, filed on Dec. 28, 2015.

(52) U.S. Cl.
CPC ..... *B26B 21/4025* (2013.01); *B26B 21/4068* (2013.01); *B26B 21/443* (2013.01)

(58) Field of Classification Search
CPC ... B26B 21/4068; B26B 21/16; B26B 21/165; B26B 21/02; B26B 21/06; B26B 21/222; B26B 21/4075; B26B 21/44; B26B 21/34; Y10T 24/44043; Y10T 24/4406
USPC ... 30/47–51, 62–68, 41, 77, 87, 57, 79, 537, 30/73, 34.05, 44, 346.5, 346.57, 34.1, 84
See application file for complete search history.

(56) References Cited

U.S. PATENT DOCUMENTS

| | | | | |
|---|---|---|---|---|
| 4,245,388 | A * | 1/1981 | Dawidowicz | B26B 21/165 30/47 |
| 4,970,784 | A * | 11/1990 | Althaus | B26B 21/225 30/50 |
| 6,035,537 | A * | 3/2000 | Apprille, Jr. | B26B 21/227 30/346.5 |
| 6,539,633 | B1 * | 4/2003 | Rebaudieres | B26B 21/4037 30/34.05 |
| 8,015,710 | B1 * | 9/2011 | Zyla | B26B 21/4037 30/34.05 |
| 8,336,212 | B2 * | 12/2012 | Bozikis | B26B 21/227 30/50 |
| 10,144,142 | B1 * | 12/2018 | Squires | B26B 21/4037 |
| 2009/0113717 | A1 * | 5/2009 | Rawle | B26B 21/227 30/50 |
| 2013/0205595 | A1 | 8/2013 | Bykowski et al. | |
| 2017/0341247 | A1 * | 11/2017 | Zafiropoulos | B26B 21/222 |

FOREIGN PATENT DOCUMENTS

| | | | |
|---|---|---|---|
| WO | 93/22112 | A1 | 11/1993 |
| WO | 2007/147420 | A1 | 12/2007 |
| WO | 2016/102024 | A1 | 6/2016 |

* cited by examiner

SHAVING RAZORS AND SHAVING CARTRIDGES

CROSS REFERENCE TO RELATED APPLICATION

This application is a National Stage application of PCT/EP2016/061854 filed May 25, 2016, which claims benefit to three separate patent applications, including (1) U.S. Provisional Application No. 62/261,389 filed Dec. 1, 2015, (2) U.S. Provisional Application No. 62/271,571 filed Dec. 28, 2015, and (3) U.S. Non-Provisional application Ser. No. 14/964,745, (now U.S. Pat. No. 9,539,734), filed Dec. 10, 2015, which claims benefit of U.S. Provisional Application No. 62/261,389 filed Dec. 1, 2015, all of which are hereby incorporated herein by reference in their entireties for all-purposes.

BACKGROUND

1. Field

The following description relates to shaving razors, shaving cartridges and retainers for such shaving cartridges. A shaving razor or shaving cartridge may include one or more blades and one or more retainers for retaining elements of the shaving razor or shaving cartridge. For example, a pair of "C" shaped retainers extending along a pair of side edges of the shaving cartridge retains the blades in position within the housing.

2. Description of Related Art

Typically, a conventional razor head includes one or more razor blades secured to a razor head housing. A number of different securing mechanisms are typically used for securing the razor blades. Such conventional mechanisms include clip retaining elements that wrap around the front and rear edges of a razor head housing and clip retaining elements that extend through one or more pairs of apertures adjacent to the front and rear ends of the housing.

During the manufacturing process, clips may encounter buckling as a result of the force that is applied during installation of the clips. The bending force exerted on the clips, the clips have to buckle upwards. Consequently, blade exposures may be unstable throughout the razor cartridge and may vary significantly from intended blade exposure values. Also, during manufacturing process, clips may fail to be properly installed in a razor housing, which requires additional attention and labor to ensure that all of the clips are properly installed in the housing. Thus, the manufacture of such conventional mechanisms is inefficient, which results in production delays and increased production costs.

SUMMARY

The present disclosure provides a retainer operable to secure a plurality of blades in a shaving unit. The retainer includes upper, intermediate, and/or lower portions, or an upper portion and one or more legs that define one or more intermediate portions and/or one or more lower portions, such that the retainer is substantially "C" shaped. The retainer also includes at least one protrusion on an inner surface of an upper portion thereof. The retainer includes at least one recess on an outer surface of an upper portion thereof. The retainer may also include one or more, preferably a plurality, of bumps or ridges on an inner surface of an upper portion thereof. The retainer of the present inventive concept may include at least one aperture extending through a surface thereof and defined by one or more of upper, intermediate, and/or lower portions thereof.

According to aspects of the disclosure, the retainer may be operable to secure a plurality of blades in a shaving blade unit or shaving cartridge and may include an upper end portion and a lower end portion connected via an intermediate portion. The end portions may extend substantially parallel to each other. The intermediate portion may extend substantially perpendicular to the end portions. The upper end portion, the intermediate portion, and the lower end portion may collectively form a "C" shape.

The retainer may further include a surface pattern formed on the upper end portion. The surface pattern may include a plurality of ridges. Each of the plurality of ridges may extend downwardly and toward the lower end portion, and may define a blade-abutment surface. The plurality of ridges may extend from a planar surface of the upper end portion. The planar surface of the upper end portion may define a plurality of additional blade-abutment surfaces. The upper end portion may be operable to abuttingly engage a surface of each blade of a shaving blade unit at one of the blade-abutment surface of the plurality of ridges, and/or one of the additional blade-abutment surfaces of the planar surface. Each of the plurality of additional blade-abutment surfaces and each of the blade-abutment surface of the plurality of ridges maybe operable to cooperatively secure one blade of a shaving blade unit. Each of the plurality of ridges may include a tip that is offset to a one side of each of the plurality of ridges.

The retainer may further include at least one protrusion formed between the plurality of ridges of the upper end portion and the intermediate portion. The protrusion may extend downwardly and toward the lower end portion. The protrusion may extend from a planar surface of the upper end portion to a tip, and may be defined by a backstop surface on a side of the protrusion and extending substantially perpendicular to the planar surface of the upper end portion, and/or an angled surface on another side of the protrusion extending between the tip of the protrusion and the planar surface of the upper end portion. The retainer may further include side surfaces defined by coplanar edges of the end portions and/or the intermediate portion. The protrusion may extend entirely between the side surfaces of the retainer, may extend partially between the side surfaces of the retainer, and/or may include a plurality of protrusions that extend between the side surfaces of the retainer and are spaced from the end portions and/or not spaced from the end portions.

The retainer may further include at least one recess formed on the upper end portion and extending inwardly and toward the lower end portion. The recess may extend entirely between the side surfaces of the retainer and along the upper end portion, may extend partially between the side surfaces of the retainer and along the upper end portion, and/or may include a plurality of recesses that extend between the side surfaces of the retainer and are spaced from the end portions and/or not spaced from the end portions.

According to further aspects, the retainer is operable to secure a plurality of blades in a shaving blade unit or shaving cartridge and may include an upper end portion with a plurality of edges. Each of the edges may define a side surface of the upper end portion. The retainer may further include a leg depending from one of the plurality of edges to form a lower end portion such that a part of the side surface of the one of the plurality of edges may be concealed by the leg, and/or another part of the side surface of the one of the plurality of edges may be exposed by the leg. The leg may be curved such that a tip of the lower end portion extends toward the upper end portion to partially enclose a cavity defined by the leg and the upper end portion.

According to some aspects, the retainer is operable to secure a plurality of blades in a shaving blade unit or shaving cartridge and may include an upper end portion with a plurality of edges. Each of the edges may define a side surface of the upper end portion. The retainer may further include a plurality of legs depending from one of the plurality of edges of the upper end portion. Each of the plurality of legs may have a lower end portion and/or may be connected to the upper end portion such that a part of the side surface of the one of the plurality of edges is concealed by each of the plurality of legs, and/or another part of the side surface of the one of the plurality of edges is exposed by each of the plurality of legs. Each of the plurality of legs may include a side surface that is coplanar to one of the side surfaces of the upper end portion. Each of the plurality of legs may be curved such that a tip of each of the lower end portions extends toward the upper end portion to partially enclose a cavity defined by the plurality of legs and/or the upper end portion.

According to some aspects, the retainer is operable to secure a plurality of blades in a shaving blade unit and may include an upper end portion with a plurality of edges. Each of the edges may define a side surface of the upper end portion. The retainer may further include a plurality of legs extending from the upper end portion such that each of the plurality of legs may conceal a part of the side surface of the one of the plurality of edges, and/or another part of the side surface of the one of the plurality of edges may be exposed by the plurality of legs. The retainer may further include a lower end portion connected to the upper end portion via at least one of the plurality of legs. The retainer may include an aperture defined by the plurality of legs, the lower end portion, and/or the upper end portion. The upper end portion that defines the aperture may be the another part of the side surface of the one of the plurality of edges of the upper end portion.

The present disclosure further provide a shaving cartridge including a housing having a front edge, a rear edge, a side edge, a top surface, and a bottom surface, a guard bar adjacent to the front edge of the housing, a cap adjacent to the rear edge, at least one blade positioned between the guard bar and the cap, and retained in position within the housing with the retainer such as described herein.

The foregoing is intended to be illustrative and is not meant to be limiting. Many features of the embodiments may be employed with or without reference to other features of any of the embodiments. Additional aspects, advantages, and/or utilities of the present disclosure will be set forth in part in the description that follows and, in part, will be apparent from the description, or may be learned by practice of the present disclosure.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present disclosure is not limited to the precise embodiments and features shown. The accompanying drawings, which are incorporated in and constitute a part of this specification, illustrate an implementation of apparatuses consistent with the present disclosure and, together with the description, serve to explain advantages and principles consistent with the present disclosure.

DETAILED DESCRIPTION

Figure 1A:
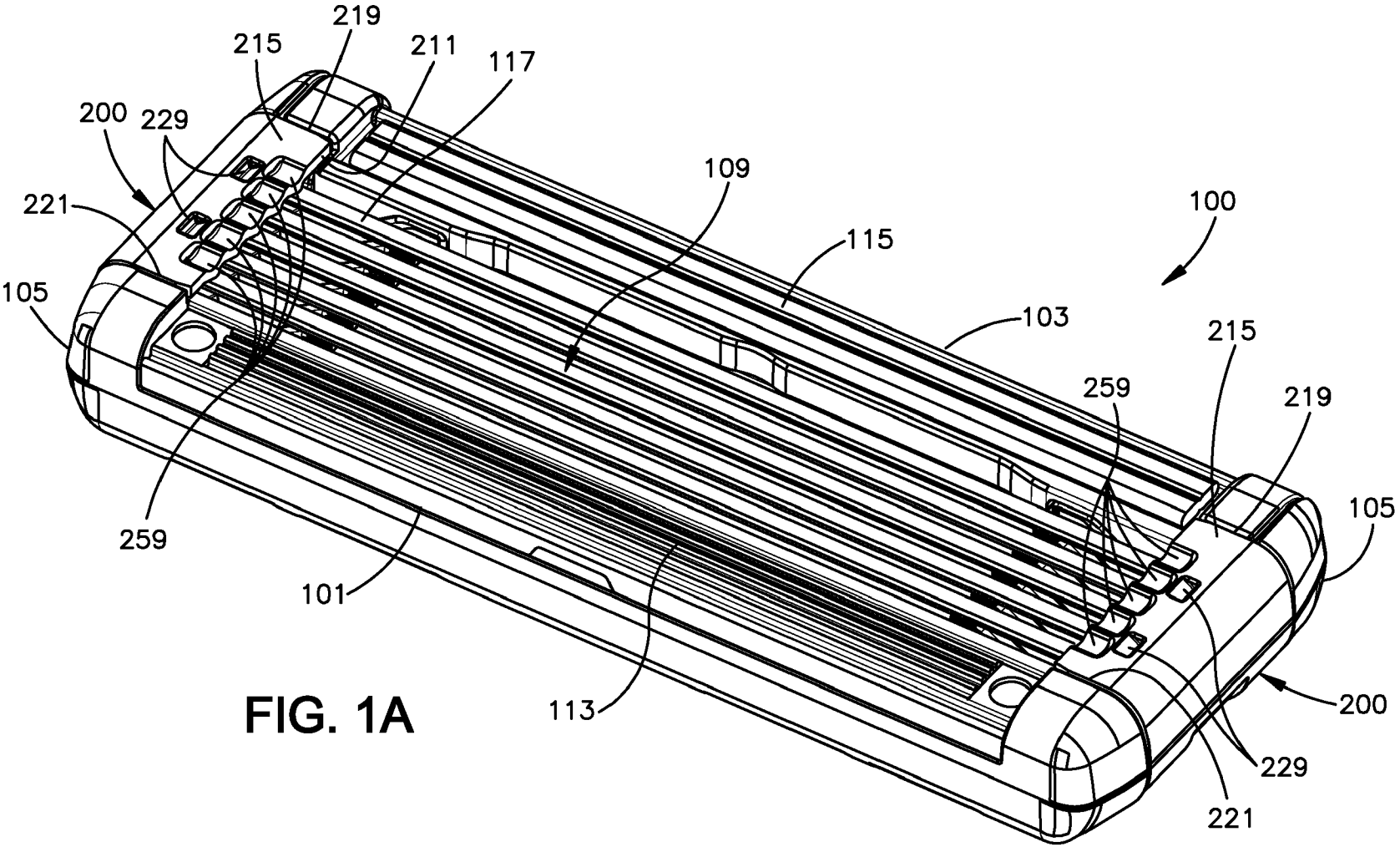
FIG. 1A is a perspective view of a shaving cartridge with retainers operable to secure blades to the cartridge.
Figure 1B:
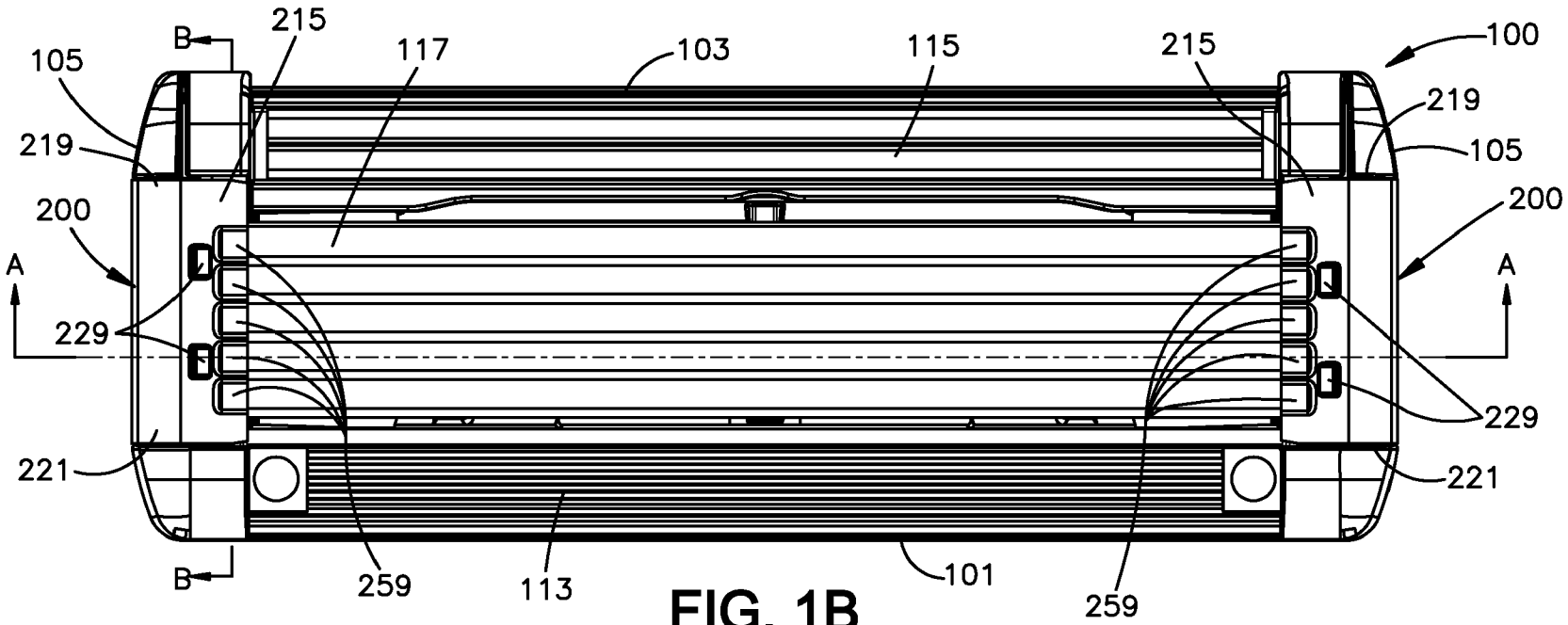
FIG. 1B is a top view of the shaving cartridge of FIG. 1A.
Figure 1C:
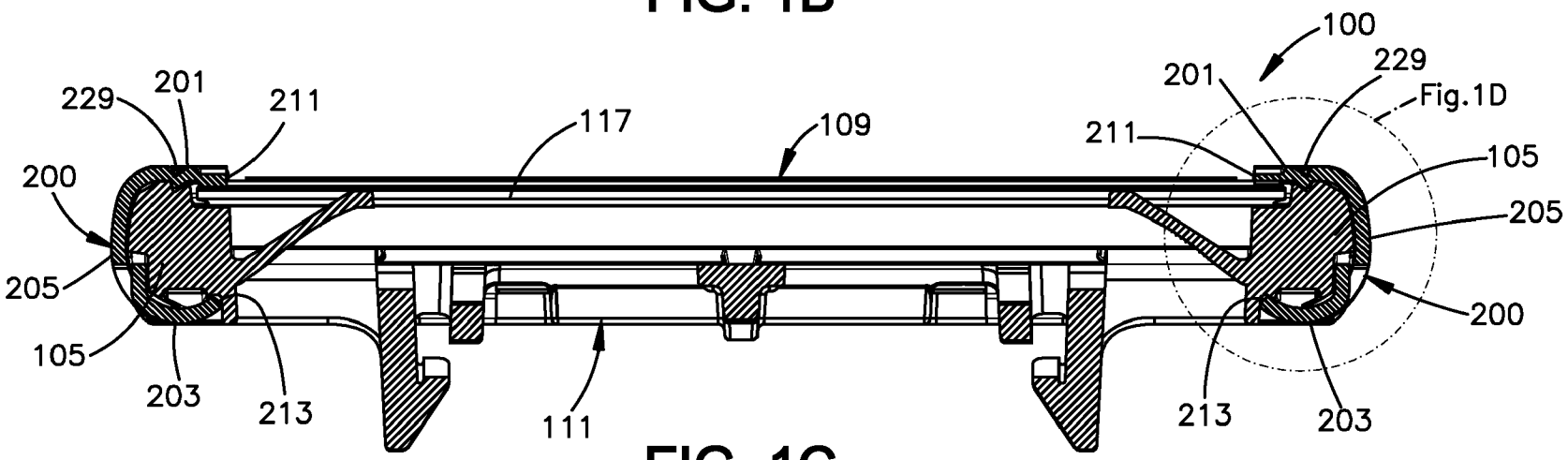
FIG. 1C is a cross-sectional view of the shaving cartridge along the line A-A shown in FIG. 1B.
Figure 1D:
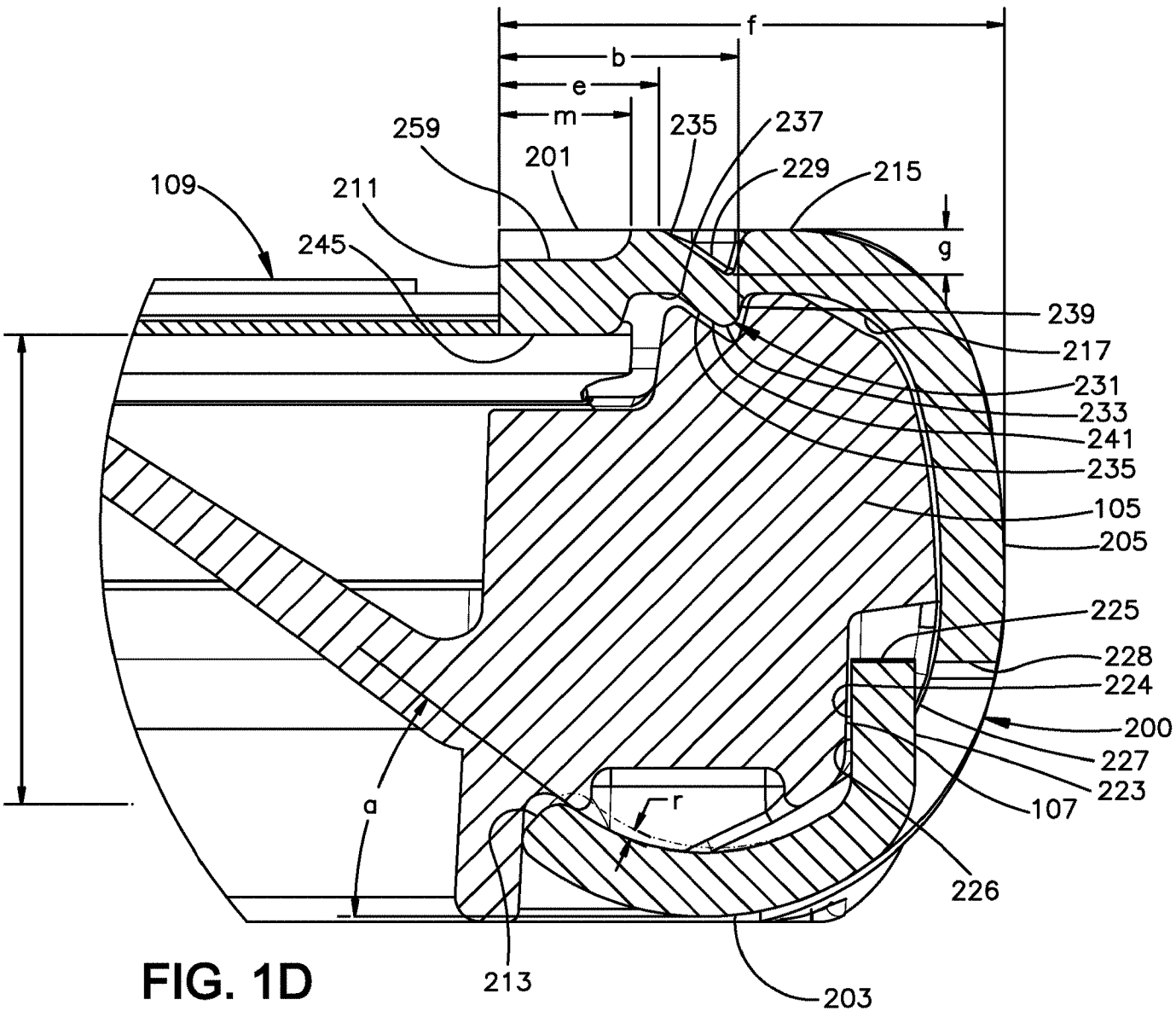
FIG. 1D is a magnified cross-sectional view of the shaving cartridge and one of the retainers in region 1D shown in FIG. 1C.
Figure 1E:
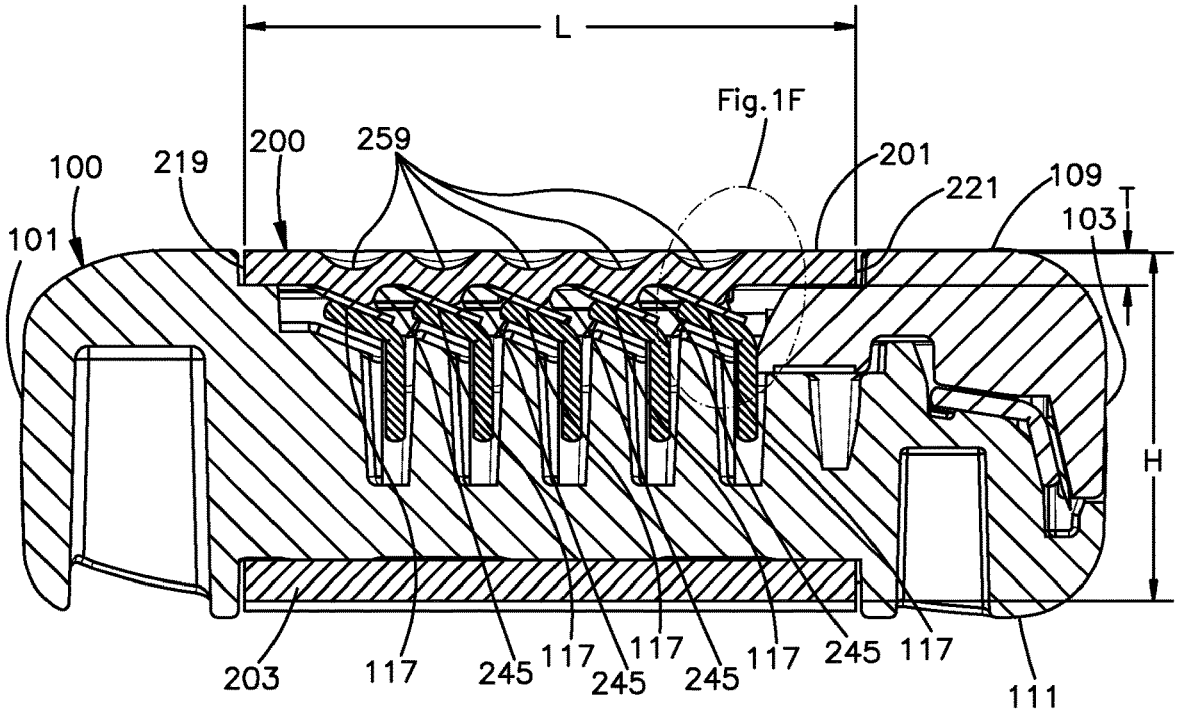
FIG. 1E is a cross-sectional view of the shaving cartridge including one of the retainers along the line B-B shown in FIG. 1B.
Figure 1F:
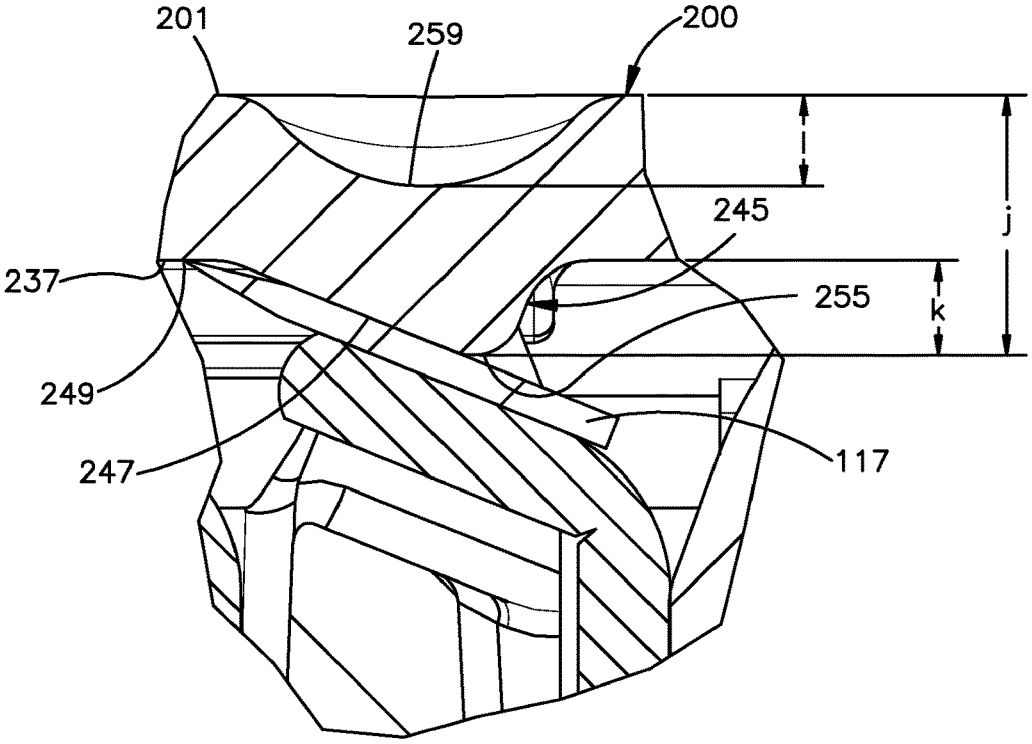
FIG. 1F is a magnified cross-sectional view of the shaving cartridge and retainer in the region 1F shown in FIG. 1E.

It is to be understood that the present disclosure is not limited in its application to the details of construction and to the embodiments of the components set forth in the following description or illustrated in the drawings. The figures and written description are provided to teach any person skilled in the art to make and use the concepts disclosed herein for which patent protection is sought. The present disclosure is capable of other embodiments and of being practiced and carried out in various ways. Persons of skill in the art will appreciate that the development of an actual commercial embodiment incorporating aspects of the present disclosure will require numerous implementations-specific decisions to achieve the 'ultimate goal of the developer for the commercial embodiment. While these efforts may be complex and time-consuming, these efforts nevertheless would be a routine undertaking for those of skill in the art of having the benefit of this disclosure.

I. Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," "side," are used in the description for clarity in specific reference to the figures and are not intended to limit the scope of the present disclosure or the appended claims. Further, it should be understood that any one of the features of the present disclosure may be used separately or in combination with other features. Other systems, methods, features, and advantages of the present disclosure will be or become apparent to one with skill in the art upon examination of the figures and the detailed description. It is intended that all such additional systems, methods, features, and advantages be included within this description, be within the scope of the present disclosure, and be protected by the accompanying claims.

Further, any term of degree such as, but not limited to, "substantially," as used in the description and the appended claims, should be understood to include an exact or a comparable but not exact configuration. For example, "substantially C" shaped means having an exact "C" shape or a comparable but not exact "C" shape. Also, "a substantially planar surface" means having an exact planar surface or a comparable, but not exact planar surface Similarly, the terms "about" or "approximately," as used in the description and the appended claims, should be understood to include the recited values or a value that is three times greater or one third of the recited values. For example, about 3 millimeters includes all values from 1 millimeter to 9 millimeters, and approximately 50 degrees includes all values from 16.6 degrees to 150 degrees.

Further, as the present disclosure is susceptible to embodiments of many different forms, it is intended that the present disclosure be considered as an example of the principles of the concepts detailed herein and not intended to limit the disclosure to the specific embodiments shown and described. Any one of the features may be used separately or in combination with any other feature. References to terms "embodiment," "embodiments," and/or the like in the description mean that the feature and/or features being referred to are included in at least one aspect of the description. Separate references to terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included. Thus, the present disclosure may include a variety of combinations and/or integrations of the embodiments described herein. Additionally, all aspects of the present disclosure, as described herein, are not essential for its practice. Likewise, other systems, methods, features, and advantages of the present inventive concept will be or become apparent to one with skill in the art upon examination of the figures and the description. It is intended that all such additional systems, methods, features, and advantages be included within this description, be within the scope of the present disclosure, and be encompassed by the claims.

Lastly, the terms "or" and "and/or," as used herein, are to be interpreted as inclusive or meaning any one or any combination. Therefore, "A, B or C" or "A, Band/or C" mean "any of the following: A, B, C; A and B; A and C; Band C; A, Band C." An exception to this definition will occur only when a combination of elements, functions, steps or acts are in some way inherently mutually exclusive.

II. General Architecture

Figure 12:
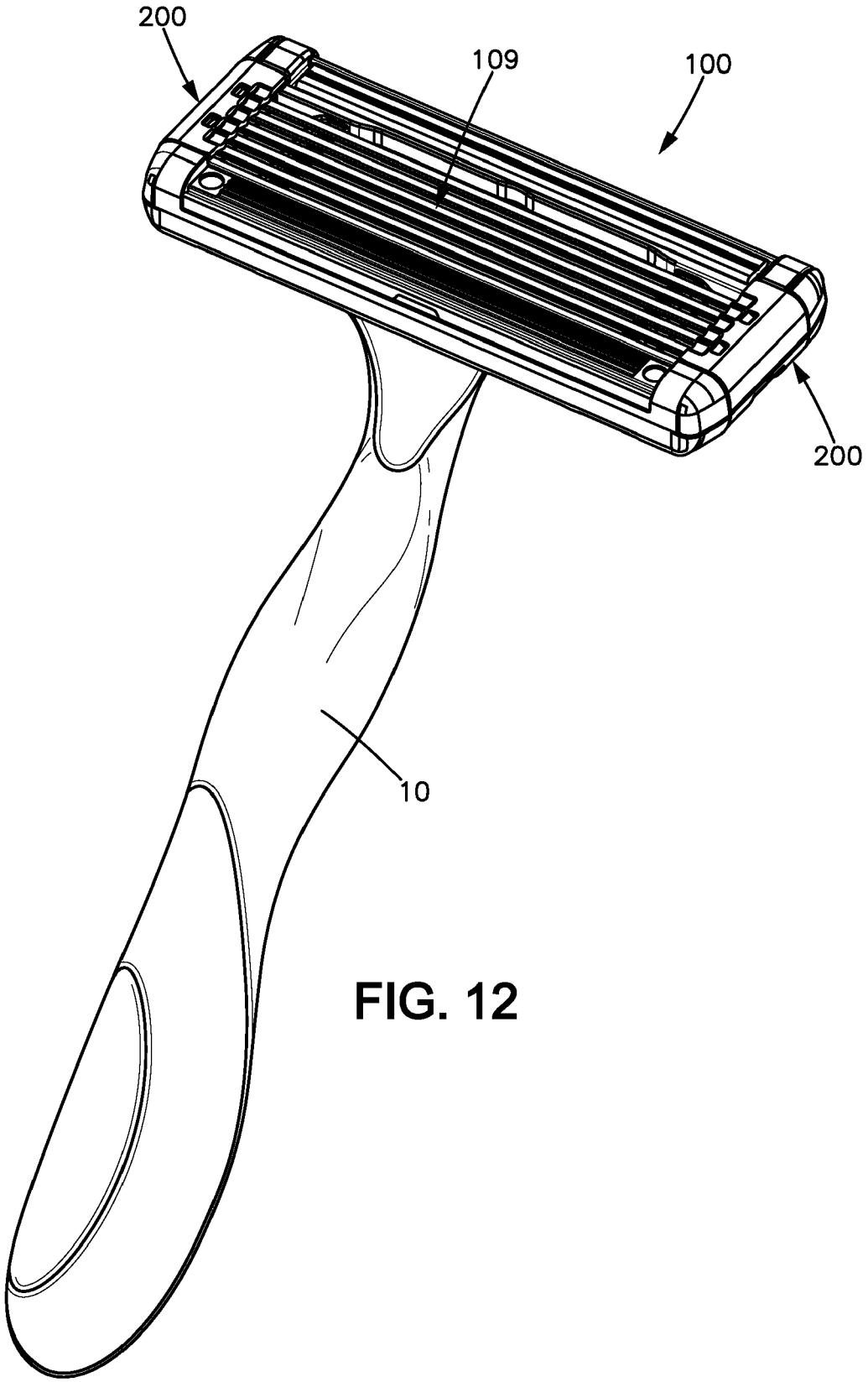
FIG. 12 is a perspective view of the cartridge shown in FIG. 1A including a handle.

According to one aspect, as shown in FIGS. 1A-1F, a shaving cartridge 100 may include a housing having a front edge 101, a rear edge 103, a side edge 105 with aperture 107 on both sides of the housing, a top surface 109, and a bottom surface 111. The pair of side edges 105 may extend between the front edge 101 of the housing and the rear edge 103 of the housing. The apertures 107 of the side edges 105 may be spaced from the edges 101, 103 and substantially centered therebetween. The shaving cartridge 100 may include a guard bar 113 adjacent to the front edge 101 of the housing and a cap 115 adjacent to the rear edge 103 of the housing. A plurality of blades 117 may be positioned between the guard bar 113 and the cap 115, and retained in position within the housing using a plurality of retainers 200 that are substantially "C" shaped. The shaving cartridge 100 may be adapted to be attached to a handle 10, and for example to be releasably connected to the handle 10 through a lock-and-release mechanism in order to form a shaver, as shown in FIG. 12. As will be apparent to one of skill in the art, it is foreseen that one or more of the plurality of retainers 200 may be otherwise shaped and yet have the same or similar functionality as discussed herein without deviating from the scope of the present disclosure. For instance, one or more of the plurality of retainers 200 may be substantially "L" shaped, "M" shaped, "T" shaped, "U" shaped, "V" shaped, "W" shaped, "Y" shaped "7" shaped and/or the like without deviating from the scope of the present disclosure. According to one aspect, the shaving cartridge 100 may include, for example, five blades 117 that are retained in position within the housing using the retainers 200, however, it may be foreseen that any number of blades, e.g., one to ten, may be used without deviating from the scope of the present disclosure.

The retainers 200 may be spaced apart and mounted on the pair of side edges 105 of the housing and on either side of the blades 117. According to some aspects, the retainers 200 may extend partially along the length L of the side edges 105, for example, about 8.5 millimeters, and may include a top or upper end portion 201 extending above the top surface 109 of the housing and over the blades 117 to retain the position of the blades 117 within the housing. According to some aspects, the retainers 200 may be modified to extend along a shorter or a longer portion of the side edges 105, without deviating from the scope of the present disclosure. For example, one or both of the retainers 200 may be modified to extend along an entire length, a shorter portion, or a longer portion of the side edges 105. Additionally, the retainers 200 may be used, with or without modifications to length, width, and/or height, to retain other components of the razor head 100 within the housing in addition to the blades 117, e.g., the guard bar 113, the cap 115, a lubrication strip, and/or a plurality of fins. Any number of the retainers 200, e.g., a single retainer or four retainers, may be used to secure and position the blades 117 or other components of the shaver cartridge 100 within the housing.

Figure 2B:
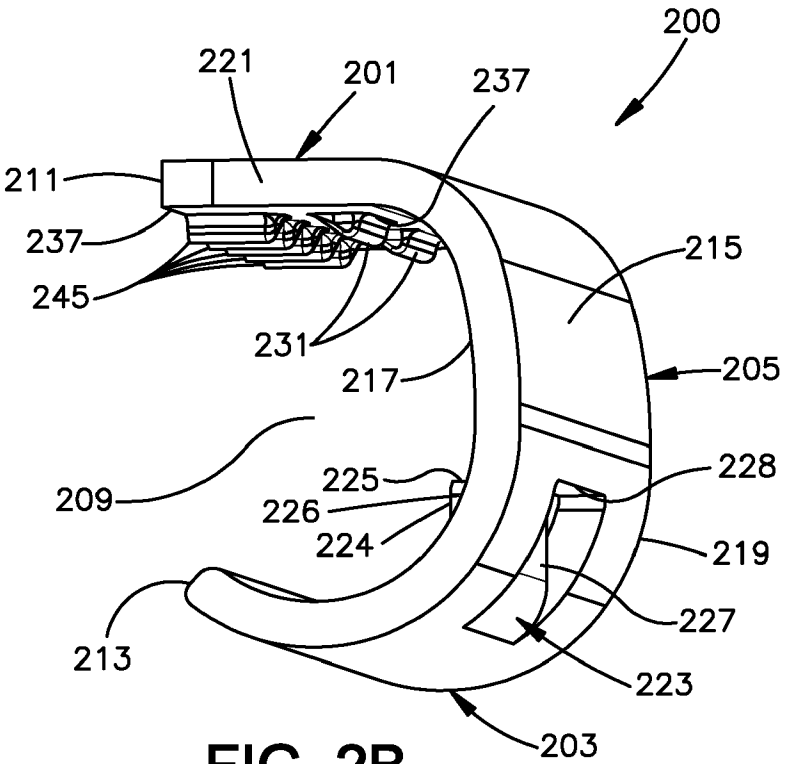
FIG. 2B is a bottom, rear perspective view of the one of the retainers shown in FIG. 2A.
Figure 2A:
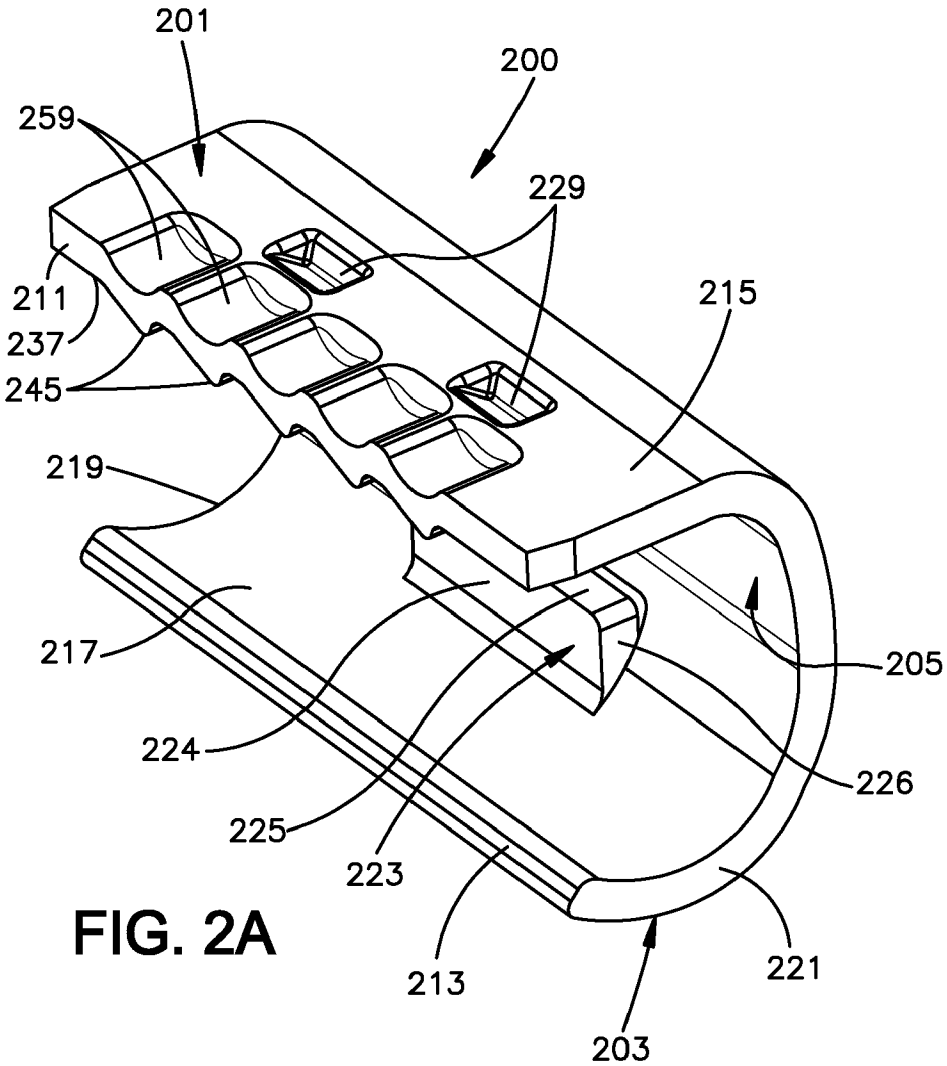
FIG. 2A is a top, front perspective view of the one of the retainers shown in FIG. 1A.

According to further aspects, the retainer 200 may include the upper end portion 201, a bottom or lower end portion 203, and a middle or intermediate portion 205, which connects the upper end portion 201 to the lower end portion 203, as illustrated in FIGS. 2A-2B. The upper end portion 201, the lower end portion 203, and the intermediate portion 205, collectively, define a cavity 209, which may be operable to securely receive a portion of the side edge 105 therein. The retainer 200 may include a first face, or tip 211, on the upper end portion 201 and a second end face, or tip 213, on the lower end portion 203, with each of the end faces/tips 211, 213 generally facing toward the blades 117. The first end face 211 is substantially planar and the second end face 213 is substantially rounded. The second end face 213 may include a curvature defined by a plurality of radii inclusive of, for example, between 0.1 millimeters and 0.25 millimeters. According to some aspects, the second end face 213 may have a curvature for example, between 0.15 millimeters and 0.2 millimeters. According to other aspects, either or both of the end faces/tips 211, 213 may be rounded, planar, or a combination thereof, without deviating from the scope of the present disclosure. An outer surface 215 of the retainer 200 may extend entirely between the end faces/tips 211, 213 and along the upper end, lower end and intermediate portions 201, 203, 205. On an opposite side of the retainer 200, an inner surface 217 may extend entirely between the end faces/tips 211, 213 and along the upper end, lower end and intermediate portions 201, 203, 205 to directly abut, and substantially surround, the side edge 105 of the housing of the cartridge 100. The retainer 200 may further include a rear edge 219 that is most adjacent to the cap 115 and a front edge 221 that is most adjacent to the guard bar 113. According to some aspects, the retainer 200 may also be designed so that the rear edge 219 is most adjacent to the guard bar 113 and the front edge 221 is most adjacent to the cap 115. According to one aspect, the rear and front edges 219, 221 may be coplanar side surfaces of the upper end, lower end and intermediate portions 201, 203, 205.

The upper end portion 201 of the retainer 200 may be substantially planar and operable to abut each of the blades 117 such that each of the blades 117 may be secured within the housing of the shaving cartridge 100. The lower end portion 203 and the intermediate portion 205 may be substantially rounded and, in coordination with the upper end portion 201, and may be operable to substantially surround a portion the side edge 105. The curvature of the lower end portion 203 may be defined by a plurality of radii inclusive of, for example, between 2 millimeters and 3 millimeters. However, according to other aspects, the curvature of the lower end portion 203 may be, for example, between 2.20 millimeters and 2.55 millimeters. The curvature of the intermediate portion 205 may be defined by a plurality of radii, for example, between 1 millimeter and 6 millimeters. According to some aspects, the intermediate portion 205 may have a curvature, for example between 1.5 millimeters and 5.9 millimeters. In this manner, the upper end portion 201 of the retainer 200 may extend along an uppermost portion of the side edge 105 and the lower end portion 203 of the retainer 200 may be curved around a lowermost portion of the side edge 105 upon installation of the retainer 200 onto the side edge 105. According to other aspects, the the lower end portion 203 and/or the intermediate portion 205 may include one or more straight portions throughout its length and/or may include a single radius of curvature, without deviating from the scope of the present disclosure.

The retainer 200 may further include a positioner 223 formed in the intermediate portion 205. On the inner surface 217 of the retainer 200, the positioner 223 may include a protruding portion 224 that extends outwardly relative to the inner surface 217 to define top and side abutment surfaces 225, 226. The protruding portion 224 of the positioner 223 may be operable to extend into and nest within the aperture 107 on the side edge 105, with the top and side abutment surfaces 225, 226 abutting adjacent walls of the aperture 107. In this manner, the protruding portion 224 of the positioner 223 may be operable to further secure the retainer 200 to the shaving cartridge 100. On the outer surface 215 of the retainer 200, the positioner 223 may include an indented portion 227 that extends inwardly relative to the outer surface 215 to expose a downwardly-facing fastening surface 228. The indented portion 227 of the positioner 223 and the surface 228 may cooperatively provide gripping surfaces operable to facilitate fastening of the retainer 200 to the aperture 107 on the side edge 105.

According to some aspects, the retainer 200 may include a plurality of recesses 229 and a plurality of protrusions 231, which may be formed on the surfaces 215, 217 of the retainer 200, respectively, and which may be cooperatively operable to further secure the retainer 200 to the shaving cartridge 100. Each of the recesses 229 may be formed on the outer surface 215 of the upper end portion 201 of the retainer 200, and may have a generally uniform semi-circular shape with a radius, for example, about 0.12 millimeters and the depth g, for example, of about 0.25 millimeters. Each of the recesses 229 may be operable to improve planar stiffness of the upper end portion 201. Each of the protrusions 231 may be formed on the inner surface 217 of the upper end portion 201 of the retainer 200, and may have a triangular shape. On a side of each of the protrusions 231, an angled surface 235 may extend between a tip 233 of each of the protrusions 231 and a planar portion 237 of the inner surface 217 of the upper end portion 201. The angled surface 235 extends at the angle c, for example, of about 55 degrees relative to a vertical line passing through the tip 233 of each of the protrusions 231. On another side of each of the protrusions 231, a backstop surface 239 may extend between the tip 233 of the each of the protrusions 231 and the inner surface 217. The backstop surface 239 may extend at the angled, for example, of about 5 degrees relative to the vertical line passing through the tip 233 of each of the protrusions 231. The depth i of each of the protrusions 231 from the uppermost part of the upper end portion 201 may be about 0.75 millimeters. Each of the protrusions 231 is operable to be received by a corresponding surface 241 on the side edge 105. The planar stiffness of the retainer 200 may be improved by the recesses 229 and may enhance an ability of the plurality of protrusions 231 to securely anchor the retainer 200 to the housing of the cartridge 100.

The retainer 200 may also a plurality of ridges 245 extending downwardly from the planar portion 237 of the upper end portion 201 and toward the lower end portion 203. The length j of the first tip 211, which includes the plurality of ridges 245, may be, for example, about 0.8 millimeters. The depth k of the plurality of ridges 245 from the planar portion 237 of the upper end portion 201 to a tip 255 of the plurality of ridges 245 may be, for example, about 0.3 millimeters. The plurality of ridges 245 extends along the upper end portion 201, i.e., from the first tip 211 to a point along the planar portion 237 that is adjacent to the plurality of protrusions 231. In this manner, the plurality of ridges 245 may be spaced from the plurality of protrusions 231. The distance e from the first tip 211 to the point along the planar portion 237 where the plurality of ridges 245 terminate may be, for example, about 5.2 millimeters.

According to some aspects, the tip 255 of each of the plurality of ridges 245 may be offset to one side of each of the plurality of ridges 245 to accommodate a planar blade-abutment surface 247. As such, each of the plurality of ridges 245 may include a curvature defined by a plurality of radii, for example, of about 0.15 millimeters. Each of the planar blade-abutment surfaces 247 may be operable abuttingly engage one of the blades 117, in coordination with another blade-abutment surface 249 of the planar portion 237 of the upper end portion 201. Each of the blade-abutment surfaces 247 may abut approximately 30%, for example, of a region of each of the blades 117. Each of the blade-abutment surfaces 249 may abut less than 10%, for example, of another region of each of the blades 117, e.g., at a single point on each of the blades 117. Accordingly, each of the blade-abutment surfaces 247, 249 may be generally aligned with and cooperatively abut, position, and retain each of the blades 117 in the shaving cartridge 100. According to some aspects, the number of the plurality of ridges 245 of the retainer 200 may be equal to the number of blades 117 of the shaving cartridge 100, for example, the retainer 200 may include five of the plurality of ridges 245 and five of the blades 117. According to other aspects, however, the retainer 200 may include any number of ridges or the retainer 200 may be provided without ridges. For example, the retainer 200 may have between none and ten ridges.

On an opposite side of the upper end portion 201 relative to the plurality of ridges 245 may be a plurality of depressions 259 in the outer surface 215. According to some aspects, each of the plurality of depressions 259 may have a generally uniform semi-circular shape, with a radius, for example, of about 0.6 millimeters and a depth I from the uppermost part of the top portion 201 to the lowermost part of the plurality of depressions 259 of about 0.275 millimeters. Similar to the plurality of ridges 245, the plurality of depressions 259 may extend along the upper end portion 201, from the first tip 211 to a point along the upper end portion 201 that is adjacent to the plurality of recesses 229. In this manner, the plurality of depressions 259 may be spaced from the plurality of recesses 229. The distance m from the first tip 211 to the point along the upper end portion 201 where the plurality of depressions 259 terminates may be, for example, about 1.0 millimeter. Similar to the plurality of recesses 229, the plurality of depressions 259 may be operable to improve planar stiffness of the upper end portion 201, which may improve an ability of the blade-abutment surfaces 247, 249 to securely abut, position, and retain each of the blades 117 in the shaving cartridge 100.

The retainer 200 may have a thickness that may range throughout the length of the retainer 200, with a greatest thickness T, for example, being approximately 0.5 millimeters. The height H of the retainer 200, from the uppermost part of the upper end portion 201 to the lowermost part of the lower end portion 203, may be for example, about 5.3 millimeters. The distance b, from the innermost part of the first tip 201 that is closest to the center of the housing to a tip 233 of each of the protrusions 231, may be for example, about 1.9 millimeters. However, according to some aspects the distance b may range, for example, from about 1.0 millimeters to about 3.0 millimeters. The distance f, from an innermost part of the first tip 211 that is closest to a center of the housing to an outermost part of the retainer 200 that is farthest from the center of the housing, may be for example, about 4.0 millimeters. However, according to some aspects, the distance f may range, for example, from about 3.0 millimeters to about 5.0 millimeters. The angle a, between the horizontal line that is tangent to a lowermost point of the lower end portion 203 and the line x that is tangent to an innermost point on the inner surface of the lower end portion 203, may be for example approximately 22 degrees, when the retainer 200 is detached from the shaving cartridge 100 and in an original or unloaded configuration. According to some aspects, the angle a may be a positive angle that can range from about 0 to about 60 degrees. The value of the angle a directly affects an ability of the retainer 200 to securely engage a specific head design, e.g., the side surface 105. For instance, a decrease in the angle a results in a tighter engagement there between and an increase in the angle a results in a looser engagement therebetween. Additionally, via the resilient nature of the material of the retainer 200, the retainer 200 may be designed so that the angle a is decreased when the retainer 200 is securely attached to the shaving cartridge 100 or in a loaded configuration, may be for example, between about 1 and 15 degrees. Thus, to secure the retainer 200 to the side surface 105, the retainer 200 may be flexibly expanded from the unloaded configuration and beyond the loaded configuration, positioned so that the side surface 105 is within the cavity 209, and released. Upon release of the retainer 200, the resilient nature of the material of the retainer 200 may cause the retainer 200 to resiliently return to its original configuration. The side surfaces 105 prevent the retainer 200 from completely returning to the unloaded configuration and may cause the lower end portion 203 of the retainer 200 to be displaced a distance r from the unloaded configuration and maintained in the loaded configuration. According to some aspects, the distance r may be, for example, about 0.1 millimeter to about 0.3 millimeters. However, according to further aspects, the distance r may be, for example, about 0.11 millimeters. In this manner, once the retainer 200 is installed in the shaving cartridge 100, with the plurality of ridges 245 abutting the blades 117, the resilient nature of the material of the retainer 200 and the displacement may cause the plurality of ridges 245 to apply a downward pressure on the blades 117, such that the blades 117 may be biased into the shaving cartridge 100. The pressure applied by the plurality of ridges 245 may advantageously maintain the position of the blades 117, thereby maintaining blade exposure of each of the blades 117, with respect to a contact plane, and maintaining shaving angle values of the shaving cartridge 100. The contact plane may refer to a plane that is formed on the surface of the guard bar 113 and the cap 115.

It should be appreciated by one of ordinary skill in the art that the dimensions and shapes of the retainer 200 are only an example of the disclosure, a number of other dimensions and/or shapes may be used for the retainer 200, as well as the plurality of protrusions 231, the plurality of recesses 229, the plurality of ridges 245, and/or the plurality of depressions 259. Such other shapes may include, but are not limited to, triangular, oblong, square, rectangular, circular, semi-circular, elliptical, and/or other related shapes. It is foreseen that such other retainer designs may include same and/or similar components to the retainer 200, so as to be easily substituted in place of the retainer 200.

According to other aspects, a retainer 300 may include an upper end portion 301, a bottom or lower end portion 303, and a middle or intermediate portion 305, which connects the upper end portion 301 to the lower end portion 303. The upper end portion 301, the lower end portion 303, and the intermediate portion 305 collectively define a cavity 309, which may be operable to securely receive the portion of the side edge 105 therein. The retainer 300 may include a first end face, or tip 311, on the upper end portion 301 and a second end face, or tip 313, on the lower end portion 303, with each of the end faces/tips 311, 313 generally facing toward the blades 117, when the retainer 300 is mounted to the cartridge 100. The first end face 311 may be substantially planar and the second end face 313 may be substantially rounded, with a curvature defined by a plurality of radii, for example, between 0.1 millimeters and 0.25 millimeters. However, according to other aspects, the second end face may have a curvature, for example, between 0.15 millimeters and 0.2 millimeters. Either or both of the tips 311, 313 may be rounded, planar, or a combination thereof, without deviating from the scope of the present disclosure. An outer surface 315 of the retainer 300 may extend entirely between the end faces/tips 311, 313 and along the upper end, lower end and intermediate portions 301, 303, 305. On an opposite side of the retainer 300, an inner surface 317 may extend entirely between the end faces/tips 311, 313 and along the upper end, lower end and intermediate portions 301, 303, 305 to directly abut, and substantially surround a portion the side edge 105 of the housing of the cartridge 100, when the retainer 300 is mounted to the cartridge 100. The retainer 300 may include a rear edge 319 that is most adjacent to the cap 115 and a front edge 321 that is most adjacent to the guard bar 113, when the retainer 300 is mounted to the cartridge 100. The retainer 300 may also be designed so that the rear edge 319 is most adjacent to the guard bar 113 and the front edge 321 is most adjacent to the cap 115. According to some aspects, the edges 319, 321 of the retainer 300 may be coplanar side surfaces of the upper end, lower end and intermediate portions 301, 303, 305.

The retainer 300 may include a positioner 323 formed in the intermediate portion 305. On the inner surface 317 of the retainer 300, the positioner 323 may include a protruding portion 324 that extends outwardly relative to the inner surface 317 and defines top and side abutment surfaces 325, 326. The protruding portion 324 of the positioner 323 may be operable to extend into and nest within the aperture 107 on the side edge 105, with the top and side abutment surfaces 325, 326 abutting adjacent walls of the aperture 107, when the retainer 300 is mounted to the cartridge 100. In this manner, the protruding portion 324 of the positioner 323 may be operable to further secure the retainer 300 to the shaving cartridge 100. On the outer surface 315 of the retainer 300, the positioner 323 may further include an indented portion 327 that may extend inwardly relative to the outer surface 315 to expose a downwardly-facing fastening surface 328. The indented portion 327 of the positioner 323 and the surface 328 may cooperatively provide gripping surfaces operable to facilitate fastening of the retainer 300 to the aperture 107 on the side edge 105.

Figure 3B:
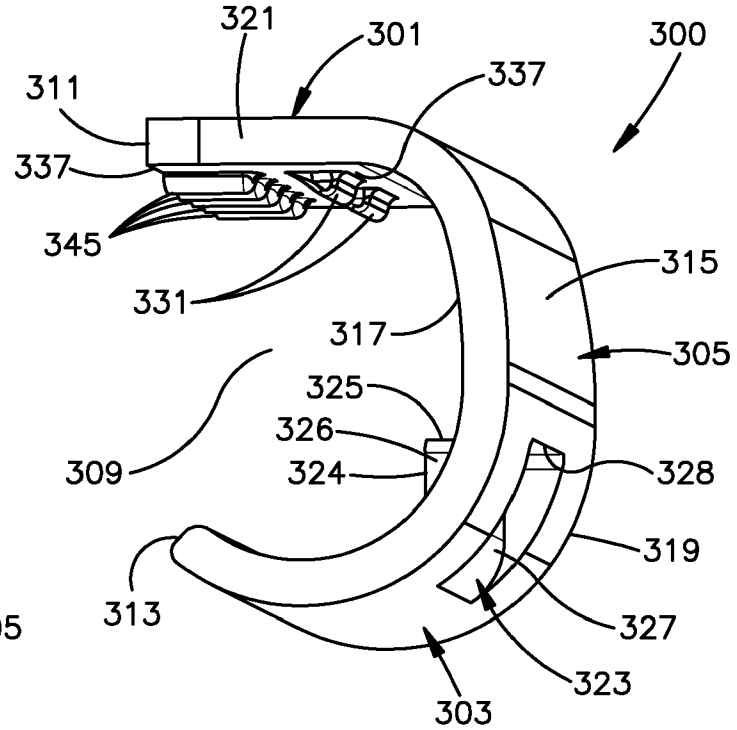
FIG. 3B is a bottom, rear perspective view of the retainer shown in FIG. 3A.
Figure 3A:
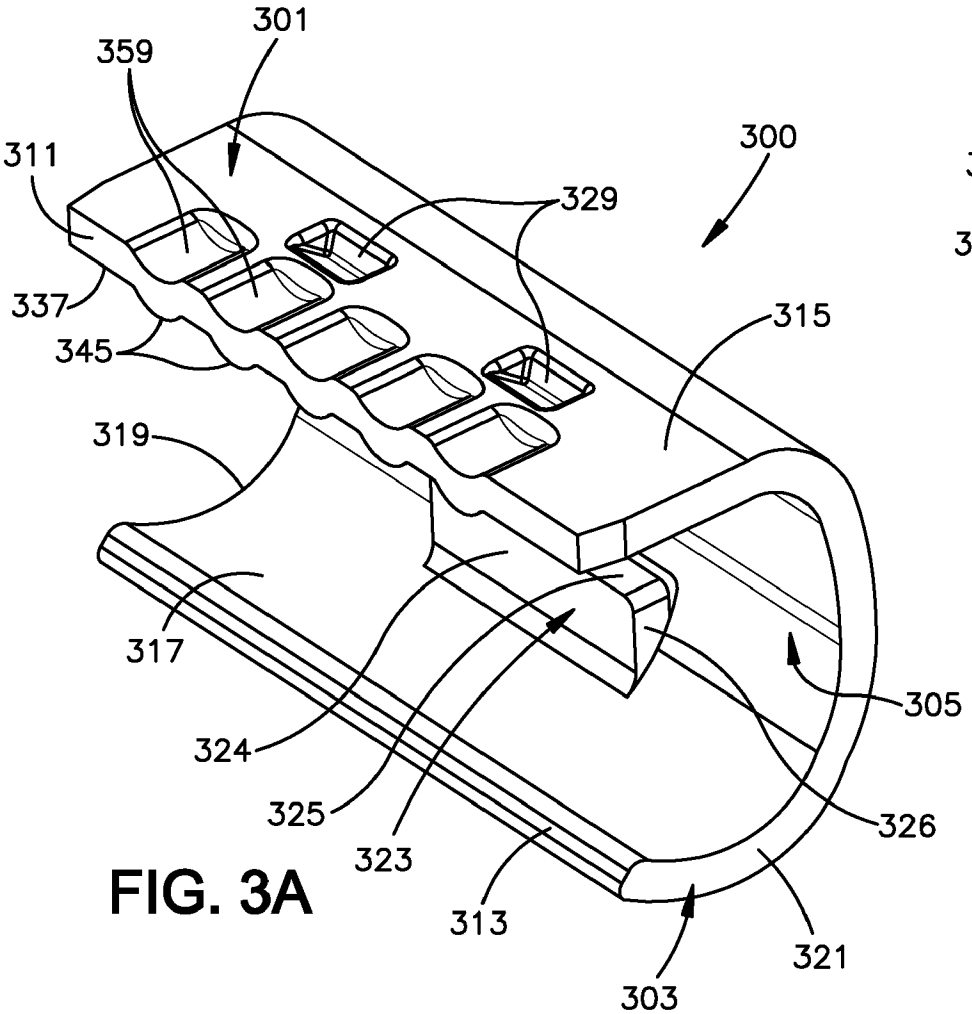
FIG. 3A is a top, front perspective view of another aspect of the retainer.
Figure 3C:
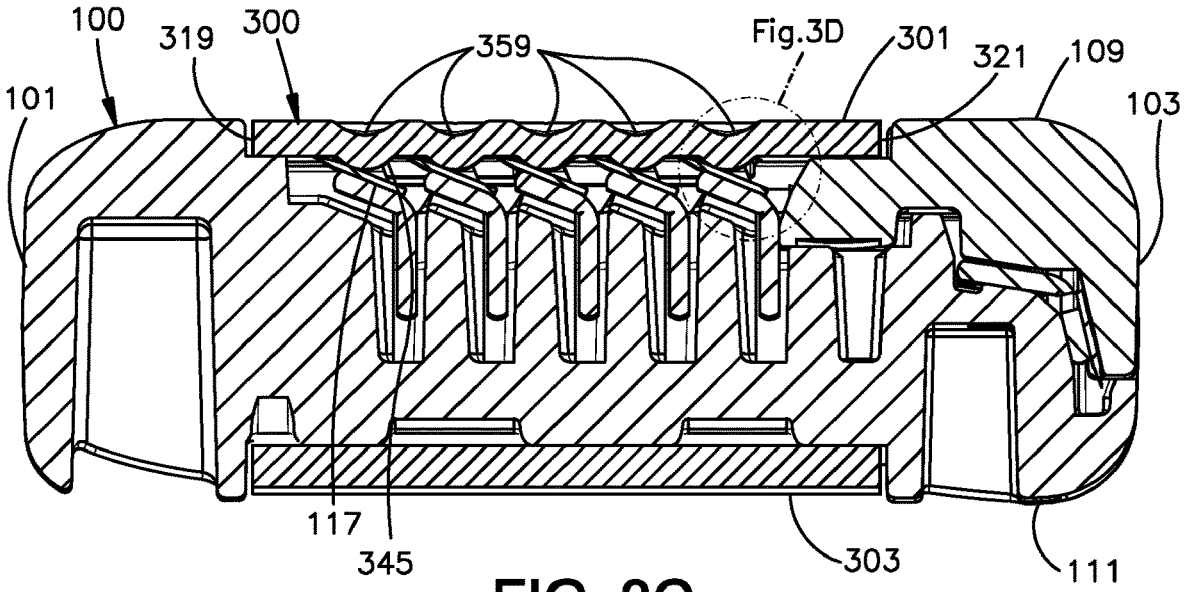
FIG. 3C is a cross-sectional view of the shaving cartridge along the line B-B shown in FIG. 1B with the retainer shown in FIG. 3B.
Figure 3D:
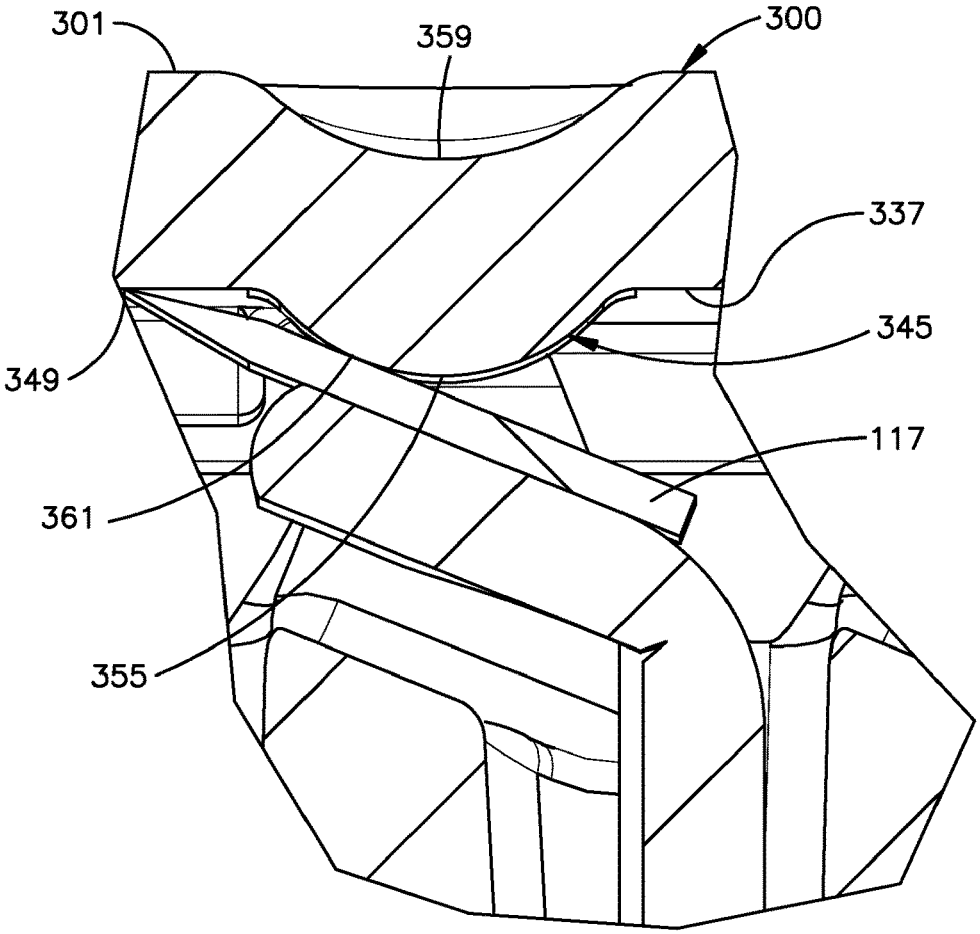
FIG. 3D is a magnified cross-sectional view of the shaving cartridge and retainer in the region 3D shown in FIG. 3C.

Similar to the retainer 200, the retainer 300 may include a plurality of recesses 329 and a plurality of protrusions 331, which are formed on the surfaces 315, 317 of the retainer 300, respectively, and may be cooperatively operable to further secure the retainer 300 to the shaving cartridge 100. The upper end portion 301 of the retainer 300 may also include a surface pattern that includes a plurality of ridges 345. The plurality of ridges 345 may extend downwardly from a planar portion 337 of the upper end portion 301 and toward the lower end portion 303. Each of the plurality of ridges 345 may include a tip 355 that is centered thereon, rather than offset as the tips 255 of the retainer 200. FIGS. 3C and 3D depict the retainer 300 mounted to the cartridge 100 in place of the retainer 200 illustrated in FIGS. 1E and 1F. According to some aspects, a blade-abutment surface 361 of each of the plurality of ridges 345 may be curved, and the plurality of ridges 345 may have a generally uniform curvature with a radius, for example, of about 0.5 millimeters. Each of the blade-abutment surfaces 361 may abut one of the blades 117 in coordination with the another blade-abutment surface 349 of the planar portion 337 of the upper end portion 301. In this manner, each of the blade-abutment surfaces 349, 361 may cooperatively abut, position, and retain each of the blades 117 in the shaving cartridge 100. On an opposite side of the upper end portion 301 relative to the plurality of ridges 345, the surface pattern of the upper end portion 301 may include a plurality of depressions 359 in the outer surface 315 of the upper end portion 301. Similar to the plurality of ridges 345, the plurality of depressions 359 may extend along the upper end portion 301, i.e., from the first tip 311 to a point along the upper end portion 301 that is adjacent to the plurality of recesses 329. The plurality of depressions 359 may be operable to improve planar stiffness of the upper end portion 301, in coordination with the plurality of recesses 329, which may improve an ability of the blade-abutment surfaces 349, 361 to securely abut, position, and retain each of the blades 117 in the shaving cartridge 100. The surface pattern formed in the upper end portion 301 of the retainer 300 may result in the first end face 311 having a curvature as illustrated in FIGS. 3C.

Figure 4B:
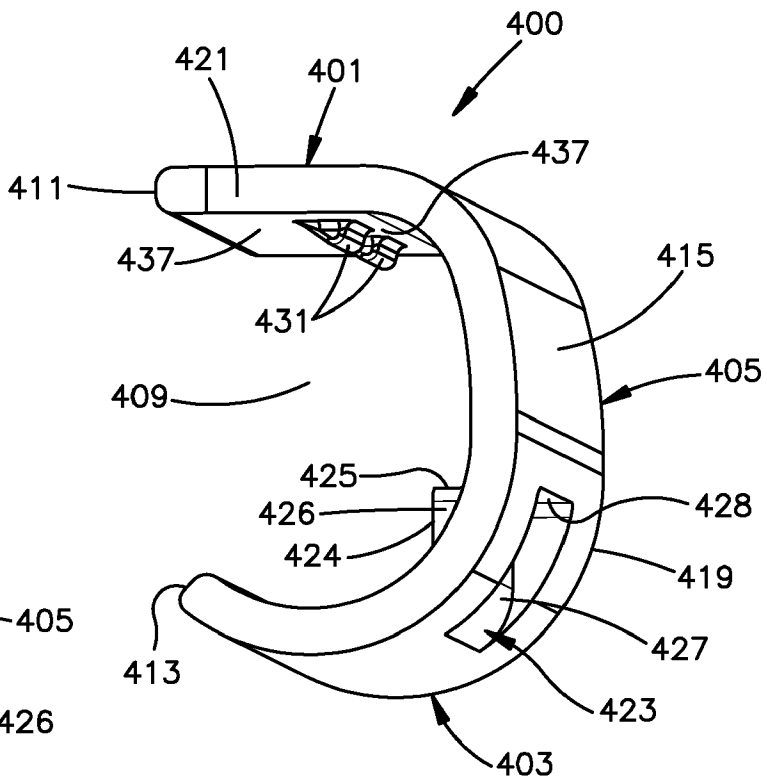
FIG. 4B is a bottom, rear perspective view of the retainer shown in FIG. 4A.
Figure 4A:
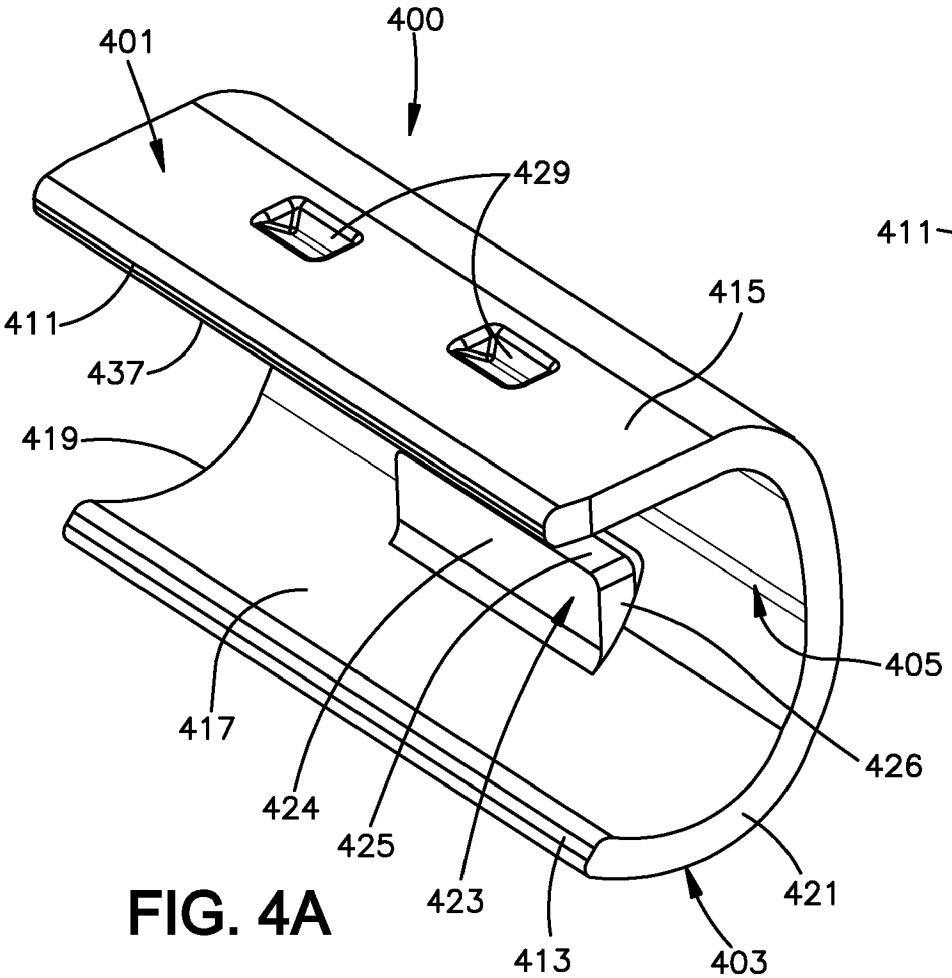
FIG. 4A is a top, front perspective view of another aspect of the retainer.

Turning to FIGS. 4A and 4B, according to further aspect, a retainer 400 may include an upper end portion 401, a bottom or lower end portion 403, and a middle or intermediate portion 405, which connects the upper end portion 401 to the lower end portion 403. The upper end portion 401, the lower end portion 403, and the intermediate portion 405 may collectively define a cavity 409, which may be operable to securely receive the portion of the side edge 105 therein. The retainer 400 may include a first end face, or tip 411, on the upper end portion 401 and a second end face, or tip 413, on the lower end portion 403, with each of the end faces/tips 411, 413 generally facing toward the blades 117, when the retainer 400 may be mounted to the cartridge 100. The end faces/tips 411, 413 may be substantially rounded, each with a curvature defined by a plurality of radii, for example, between 0.1 millimeters and 0.25 millimeters, and preferably inclusive of, about, and/or between 0.15 millimeters and 0.2 millimeters. It is foreseen that either or both of the end faces/tips 411, 413 may be rounded, planar, or a combination thereof, without deviating from the scope of the present disclosure. An outer surface 415 of the retainer 400 may extends entirely between the end faces/tips 411, 413 and along the upper end, lower end and intermediate portions 401, 403, 405. On an opposite side of the retainer 400, an inner surface 417 may extend entirely between the end faces/tips 411, 413 and along the upper end, lower end and intermediate portions 401, 403, 405 to directly abut and substantially surround a portion of the side edge 105 of the housing of the cartridge 100, when the retainer 300 is mounted to the cartridge 100. The retainer 400 may include a rear edge 419 that is adjacent to the cap 115 and a front edge 421 that is adjacent to the guard bar 113 when the retainer 400 is mounted to the cartridge 100. The retainer 400 may also be designed so that the rear edge 419 is most adjacent to the guard bar 113 and the front edge 421 is most adjacent to the cap 115 According to some aspects, the edges 419, 421 of the retainer 400 are coplanar side surfaces of the portions upper end, lower end and intermediate 401, 403, 405.

Similar to the retainers 200, 300, the retainer 400 may include a positioner 423 formed in the intermediate portion 405. On the inner surface 417 of the retainer 400, the positioner 323 may include a protruding portion 424 that extends outwardly and defines top and side abutment surfaces 425, 426. The protruding portion 424 of the positioner 423 may be operable to extend into and nest within the aperture 107 on the side edge 105, with the top and side abutment surfaces 425, 426 abutting adjacent walls of the aperture 107, when the retainer 400 is mounted to the cartridge 100. In this manner, the protruding portion 424 of the positioner 423 may be operable to further secure the retainer 400 to the shaving cartridge 100. On the outer surface 415 of the retainer 400, the positioner 423 may include an indented portion 427 that extends inwardly to expose a downwardly-facing fastening surface 428. The indented portion 27 of the positioner 423 and the surface 428 may cooperatively provide gripping surfaces operable to facilitate fastening of the retainer 400 to the aperture 107 on the side edge 105.

Similar to the retainers 200, 300, the retainer 400 may include a plurality of recesses 429 and a plurality of protrusions 431, which are formed on the surfaces 415, 417 of the retainer 400, respectively, and may be cooperatively operable to further secure the retainer 400 to the shaving cartridge 100. The upper end portion 401 of the retainer 400 may also include a surface pattern, but does not include any ridges or depressions. Rather, the surface pattern of the upper end portion 401 of the retainer 400 may be substantially planar and has a planar portion 437. In this manner, the planar portion 437 may be operable to abut, position, and retain each of the blades 117 in the shaving cartridge 100 when the retainer 400 is mounted to the cartridge 100. The surface pattern formed in the upper end surface 401 of the retainer 400 may result in the tip 411 having substantially planar upper and lower surfaces.

Figure 5B:
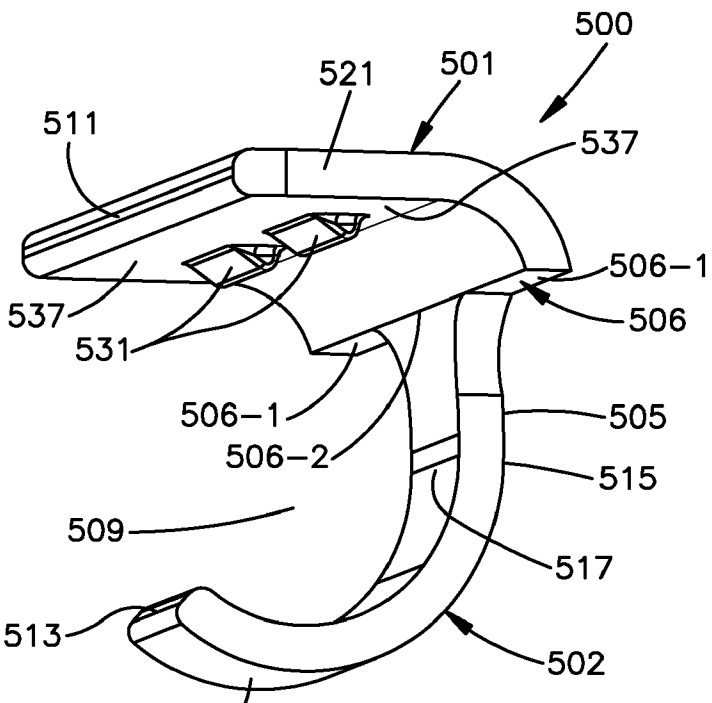
FIG. 5B is a bottom, rear perspective view of the retainer shown in FIG. 5A.
Figure 5A:
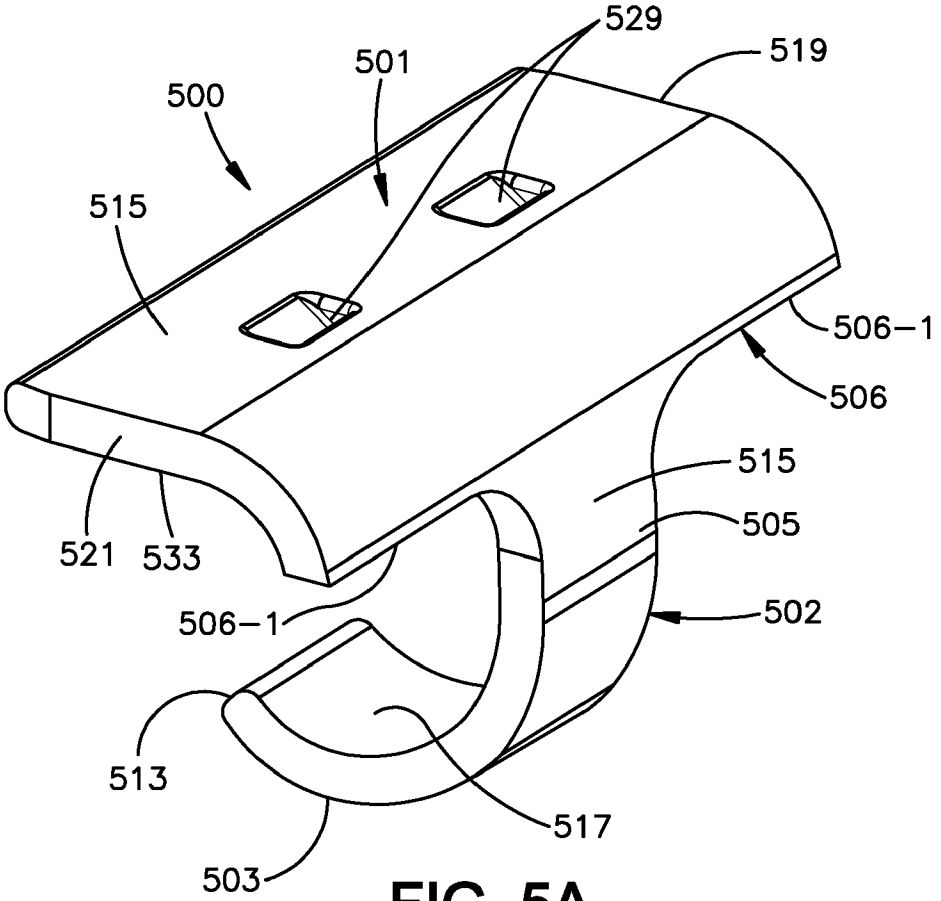
FIG. 5A is a top, front perspective view of another aspect of the retainer.

According to further aspects, as shown in FIGS. 5A and 5B, a retainer 500 may include an upper end portion 501, but may also include a leg 502 having a bottom or lower end portion 503, and a middle or intermediate portion 505. The leg 502 may depend from only a portion of an edge 506 of the upper end portion 501. In this manner, the leg 502 may cause an exposed portion 506-1 of the edge 506 to be exposed by the leg 502, and a concealed portion 506-2 of the edge 506 to be concealed by the leg 502. In the present embodiment, the leg 502 is integrally formed with the upper end portion 501. The leg 502, however, may also be manufactured separately from the upper end portion 501 and secured thereto during manufacturing of the retainer 500, for example, by welding, glue, or other attachment means.

The intermediate portion 505 may connect the upper end portion 501 to the lower end portion 503. The upper end portion 501, the lower end portion 503, and the intermediate portion 505 may collectively define a cavity 509, which may be operable to securely receive the portion of the side edge 105 therein. The retainer 500 may include a first end/face, or tip 511, on the upper end portion 501 and a second end face/face, or tip 513, on the lower end portion 503, with each of the end faces/tips 511, 513 generally facing toward the blades 117, when the retainer 500 is mounted to the cartridge 100. The end faces/tips 511, 513 may be substantially rounded, each with a curvature defined by a plurality of radii, for example, between 0.1 millimeters and 0.25 millimeters According to other aspects, the radius of curvature of the end faces/tips 511, 513 may also be, for example, between 0.15 millimeters and 0.2 millimeters. Either or both of the end faces/tips 511, 513 may be rounded, planar, or a combination thereof. An outer surface 515 of the retainer 500 may extend entirely between the end faces/tips 511, 513 and along the upper end, lower end and intermediate portions 501, 503, 505. On an opposite side of the retainer 500, an inner surface 517 may extend entirely between the end faces/tips 511, 513 and along the upper end, lower end and intermediate portions 501, 503, 505 to directly abut and substantially surround a portion of the side edge 105 of the housing of the cartridge 100 when the retainer 500 is mounted to the cartridge 100. The upper end surface 501 of the retainer 500 may include a rear edge 519 that is adjacent to the cap 115 and a front edge 521 that is adjacent to the guard bar 113 when the retainer 500 is mounted to the cartridge 100. The retainer 500 may also be designed so that the rear edge 519 is most adjacent to the guard bar 113 and the front edge 521 is most adjacent to the cap 115. According to some aspects, edges 519, 521 of the upper end surface 501 of the retainer 500 are not coplanar to side surfaces of the portions 503, 505.

Unlike the retainers 200, 300, 400, the retainer 500 does not include a positioner. Similar to the retainers 200, 300, 400, the retainer 500 may include a plurality of recesses 529 and a plurality of protrusions 531, which are formed on the surfaces 515, 517 of the retainer 500, respectively, and may be cooperatively operable to further secure the retainer 500 to the shaving cartridge 100 when the retainer 500 is mounted to the cartridge 100. The upper end portion 501 of the retainer 500 may also include a surface pattern without any ridges or depressions. The surface pattern of the upper end portion 501 of the retainer 500 may be substantially planar and may include a planar portion 537. In this manner, the planar portion 537 may be operable to abut, position, and retain each of the blades 117 in the shaving cartridge 100 when the retainer 500 is mounted to the cartridge 100. The surface pattern formed in the upper end surface 501 of the retainer 500 may result in the tip 511 having substantially planar upper and lower surfaces. Relative to the retainers 200, 300, 400, the reduced sizes of the intermediate portion 507 and the lower end portion 509 of the leg 502 may advantageously provide increased resilience of the leg 502, which may facilitate assembly of the shaving cartridge 100 using the retainer 500. Likewise, the reduced sizes of the intermediate portion 507 and the lower end portion 509 may advantageously provide increased exposure of, and access to, the pair of side edges 105 while reducing material consumption and manufacturing costs. For instance, according to further aspects, the increased exposure of the side edges 105 may allow an additional user to view a component such as a visual usage indicator, not shown. According to even further aspects, at least a portion of the retainer 500 may be made of a transparent material to allow a user to view an additional component such as the visual usage indicator. The additional component may be positioned on one or both of the side edges 105 and adjacent to the blades 117. The additional component may be operable to communicate a status of the cartridge 100 to the user based on one or more other components of the cartridge 100, for example, whether the cartridge 100 is new and functional, used and partially functional, and/or depleted and non-functional.

Figure 6B:
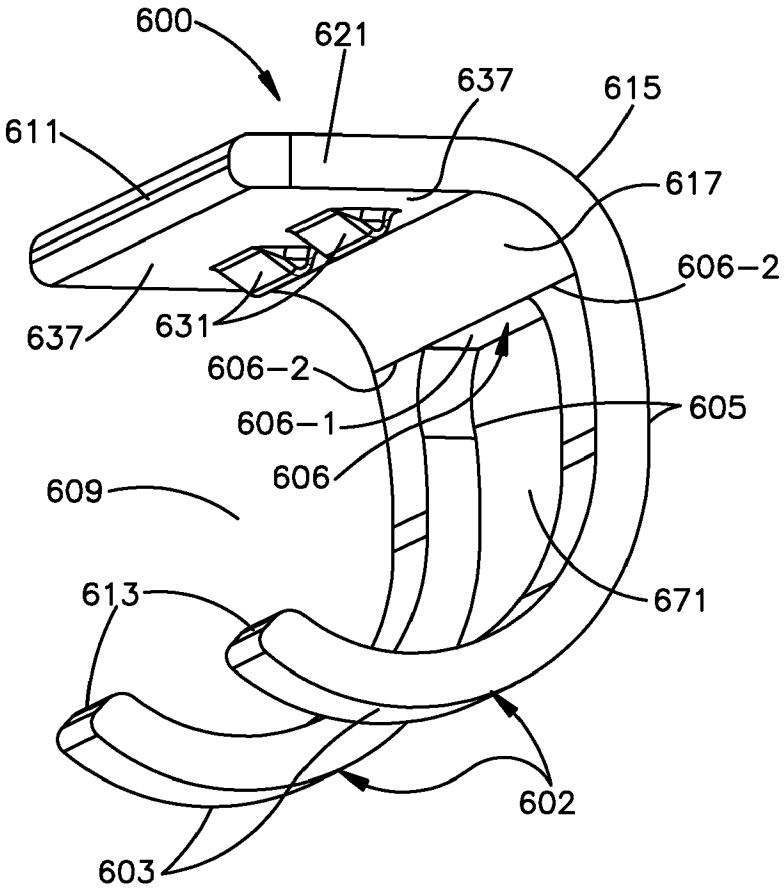
FIG. 6B is a bottom, rear perspective view of the retainer shown in FIG. 6A.
Figure 6A:
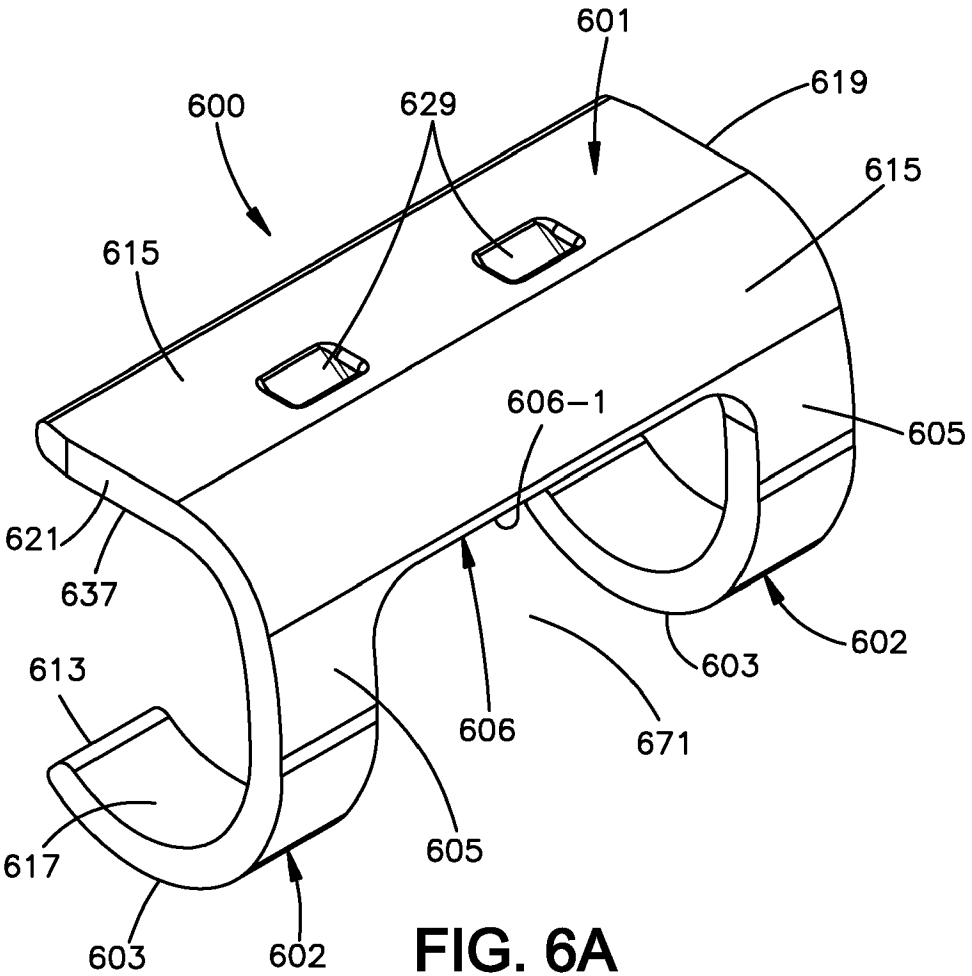
FIG. 6A is a top, front perspective view of another aspect of the retainers shown in FIG. 1A.

According to another aspect, as shown in FIGS. 6A and 6B, a retainer 600, similar to the retainer 500, may also include an upper end portion 601, but includes a plurality of legs 602, each of the plurality of legs 602 may have a bottom or lower end portion 603, and a middle or intermediate portion 605. Each of the legs 602 may depend from only a portion of an edge 606 of the upper end portion 601. In this manner, the legs 602 may cause an exposed portion 606-1 of the edge 606 to be exposed by the legs 602, and a concealed portion 606-2 of the edge 606 to be concealed by the legs 602. According to some aspects, each of the legs 602 may be integrally formed with the upper end portion 601. One or both of the legs 602 may be manufactured separately from the upper end portion 601 and secured thereto during manufacturing of the retainer 600, such as, for example, via welding, glue, or other attachment means.

Each of the intermediate portions 605 may connect the upper end portion 601 to the lower end portions 603. The upper end portion 601, the lower end portions 603, and the intermediate portions 605 may collectively define a cavity 609, which may be operable to securely receive the portion of the side edge 105 therein. The retainer 600 may include a first end face, or tip 611, on the upper end portion 601 and a second end face, or tip 613, on each of the lower end portion 603 with each of the tips 611, 613 generally facing toward the blades 117 when the retainer 600 is mounted to the cartridge 100. The end faces/tips 611, 613 may be substantially rounded, each with a curvature defined by a plurality of radii such as for example, between 0.1 millimeters and 0.25 millimeters According to some aspects, the curvature of the end faces/tips 611, 613 may be, for example, between 0.15 millimeters and 0.2 millimeters. Either or both of the end faces/tips 611, 613 may be rounded, planar, or a combination thereof. An outer surface 615 of the retainer 600 may extend entirely between the tips 611, 613 and along the upper end, lower end and intermediate portions 601, 603, 605. On an opposite side of the retainer 600, an inner surface 617 may extend entirely between the tips 611, 613 and along the upper end, lower end and intermediate portions 601, 603, 605 to directly abut and substantially surround a portion of the side edge 105 of the housing of the cartridge 100 when the retainer 600 is mounted to the cartridge 100. The upper end surface 601 of the retainer 600 may include a rear edge 619 that is adjacent to the cap 115 and a front edge 621 that is adjacent to the guard bar 113 when the retainer 600 is mounted to the cartridge 100. The retainer 600 may also be designed so that the rear edge 619 is most adjacent to the guard bar 113 and the front edge 621 is most adjacent to the cap 115. According to some aspects, the edges 619, 621 of the retainer 600 may be coplanar side surfaces of the portions 601, 603, 605. Similar to the retainer 500, the retainer 600 does not include a positioner. The retainer 600 may also include a plurality of recesses 629 and a plurality of protrusions 631, which may be formed on the surfaces 615, 617 of the retainer 600, respectively, and may be cooperatively operable to further secure the retainer 600 to the shaving cartridge 100 when the retainer 600 is mounted to the cartridge 100. The upper end portion 601 of the retainer 600 may also include a surface pattern without any ridges or depressions. The surface pattern of the upper end portion 601 of the retainer 600 may be substantially planar and may include a planar portion 637. In this manner, the planar portion 637 may be operable to abut, position, and retain each of the blades 117 in the shaving cartridge 100, when the retainer 600 is mounted to the cartridge 100. The surface pattern formed in the upper end surface 601 of the retainer 600 may result in the tip 611 having substantially planar upper and lower surfaces.

Relative to the retainers 200, 300, 400, the reduced sizes of the intermediate portions 605 and the lower end portions 603 of the legs 602 advantageously provide increased resilience of the legs 602, which may facilitate assembly of the shaving cartridge 100 using the retainer 600. Likewise, the reduced sizes of the intermediate portions 605 and the lower end portions 603 partially define an aperture 671, which may advantageously provide increased exposure of, and access to, the pair of side edges 105 while reducing material consumption and manufacturing costs. The increased exposure of the side edges 105 may also allow a user to view an additional component such as a visual usage indicator. According to some aspects, at least a portion of the retainer 600 could be made of a transparent material to allow a user to view an additional component such as the visual usage indicator. The additional component may be positioned on one or both of the side edges 105 and adjacent to the blades 117. The component may be operable to communicate a status of the cartridge 100 to the user based on one or more other components of the cartridge 100, for example, whether the cartridge 100 is new and functional, used and partially functional, and/or depleted and non-functional.

Figure 7B:
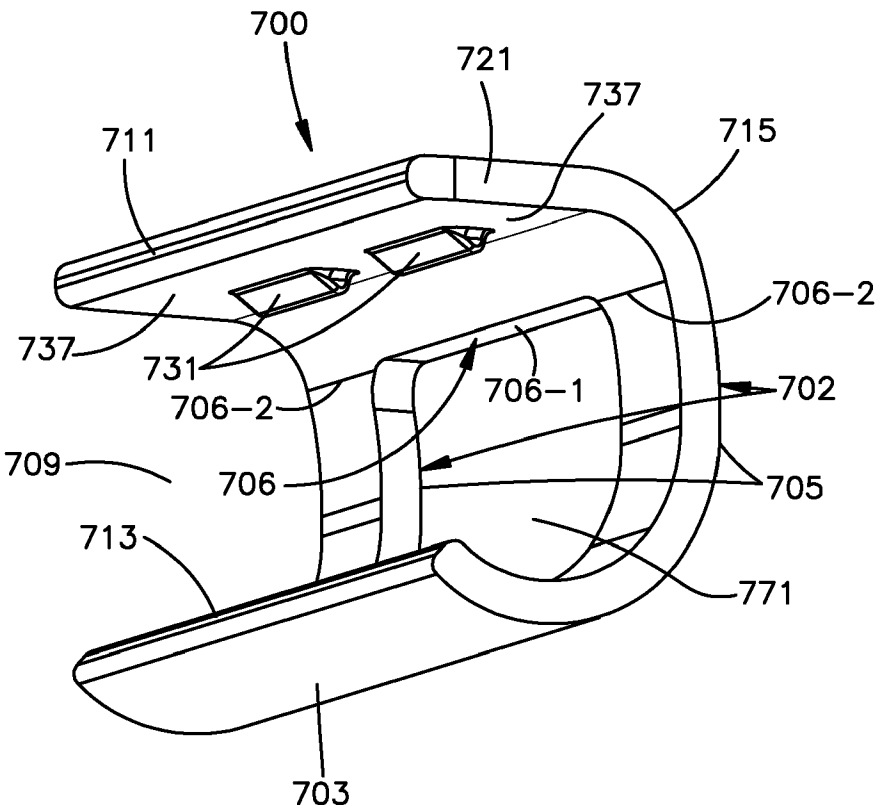
FIG. 7B is a bottom, rear perspective view of the retainer shown in FIG. 7A.
Figure 7A:
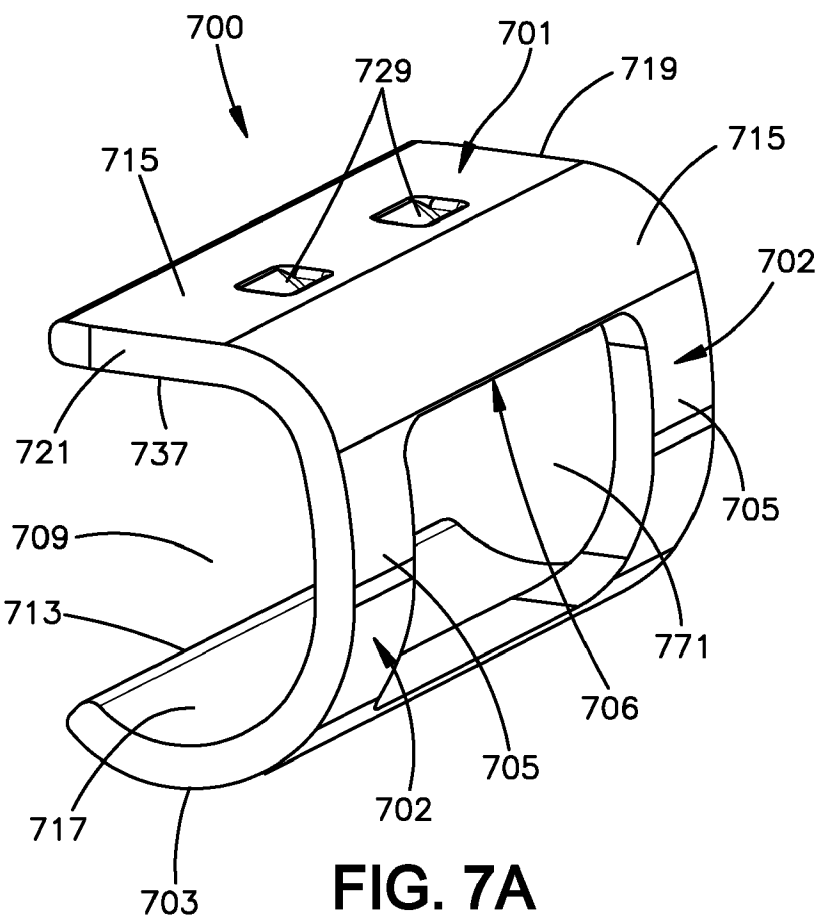
FIG. 7A is a top, front perspective view of another aspect of the retainer.

According to other aspects, as shown in FIGS. 7A and 7B, a retainer 700 may include an upper end portion 701 and a plurality of legs 702 forming at least a portion of an intermediate portion 705. Each of the legs 702 may secure a common bottom or lower end portion 703 to the upper end portion 701 via the middle or intermediate portions 705. Each of the legs 702 may depend from only a portion of an edge 706 of the upper end portion 701. In this manner, the legs 702 may cause an exposed portion 706-1 of the edge 706 to be exposed by the legs 702, and a concealed portion 706-2 of the edge 706 to be concealed by the legs 702. According to some aspects, each of the legs 702 may be integrally formed with the upper end portion 701. Additionally, one or both of the legs 702 may be manufactured separately from the upper end portion 701 and secured thereto during manufacturing of the retainer 700, for example, via welding, glue, or other attachment means. The upper end portion 701, the lower end portion 703, and the intermediate portions 705 may collectively define a cavity 709, which may be operable to securely receive the portion of the side edge 105 therein. The retainer 700 may include a first end face, or tip 711, on the upper end portion 701 and a second face, or tip 713, on the lower end portion 703 with each of the end faces/tips 711, 713 generally facing toward the blades 117 when the retainer 700 is mounted to the cartridge 100. The end faces/tips 711, 713 may be substantially rounded, each with a curvature defined by a plurality of radii, for example, between 0.1 millimeters and 0.25 millimeters According to some aspects, the curvature of the end faces/tips 711, 713 may be, for example, between 0.15 millimeters and 0.2 millimeters. Either or both of the end faces/tips 711, 713 may be rounded, planar, or a combination thereof. An outer surface 715 of the retainer 700 may extend entirely between the end faces/tips 711, 713 and along the upper end, lower end and intermediate portions 701, 703, 705. On an opposite side of the retainer 700, an inner surface 717 may extend entirely between the end faces/tips 711, 713 and along the upper end, lower end and intermediate portions 701, 703, 705 to directly abut and substantially surround a portion of the side edge 105 of the housing of the cartridge 100 when the retainer 700 is mounted to the cartridge 100. The upper end surface 701 of the retainer 700 may include a rear edge 719 that is adjacent to the cap 115 and a front edge 721 that is adjacent to the guard bar 113 when the retainer 700 is mounted to the cartridge 100. According to other aspects, the retainer 700 may also be designed so that the rear edge 719 is most adjacent to the guard bar 113 and the front edge 721 is most adjacent to the cap 115 without deviating from the scope of the present inventive concept. The edges 719, 721 of the retainer 700 may be coplanar side surfaces of the upper end, lower end and intermediate portions 701, 703, 705. Similar to the retainers 500, 600, the retainer 700 does not include a positioner. According to some aspects, the retainer 700 may also include a plurality of recesses 729 and a plurality of protrusions 731, which are formed on the surfaces 715, 717 of the retainer 700, respectively, and may be cooperatively operable to further secure the retainer 700 to the shaving cartridge 100 when the retainer 700 is mounted to the cartridge 100. Similar to the retainers 400, 500, 600, the upper end portion 701 of the retainer 700 may also include a surface pattern without any ridges or depressions. The surface pattern of the upper end portion 701 of the retainer 700 may be substantially planar and has a planar portion 737. In this manner, the planar portion 737 may be operable to abut, position, and retain each of the blades 117 in the shaving cartridge 100 when the retainer 700 is mounted to the cartridge 100. The surface pattern formed in the upper end surface 701 of the retainer 700 may result in the tip 711 having substantially planar upper and lower surfaces. Relative to the retainers 200, 300, 400, the reduced sizes of the intermediate portions 705 of the legs 702 may advantageously provide increased resilience of the legs 702, which may facilitate assembly of the shaving cartridge 100 using the retainer 700. Likewise, the reduced sizes of the intermediate portions 705 partially define an aperture 771, which may advantageously provide increased exposure of, and access to, the pair of side edges 105 while reducing material consumption and manufacturing costs. According to some aspects, the increased exposure of the side edges 105 may allow a user to view an additional component such as a visual usage indicator. According to further aspects, at least a portion of the retainer 700 may be made of a transparent material to allow a user to view an additional component such as the visual usage indicator. The component may be positioned on one or both of the side edges 105 and adjacent to the blades 117. The component may be operable to communicate a status of the cartridge 100 to the user based on one or more other components of the cartridge 100, e.g., whether the cartridge 100 is new and functional, used and partially functional, and/or depleted and non-functional.

Figure 8B:
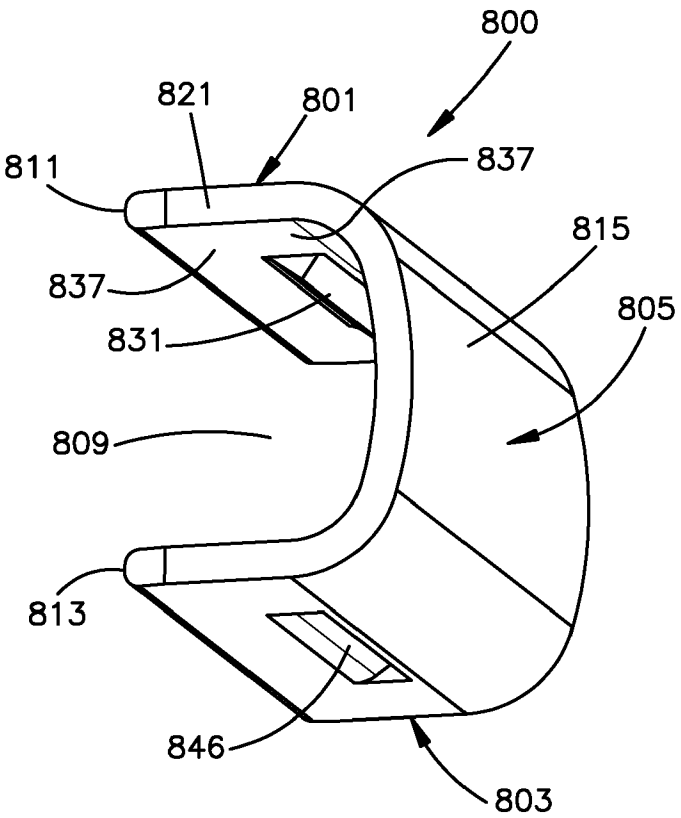
FIG. 8B is a bottom, rear perspective view of the retainer shown in FIG. 8A.
Figure 8A:
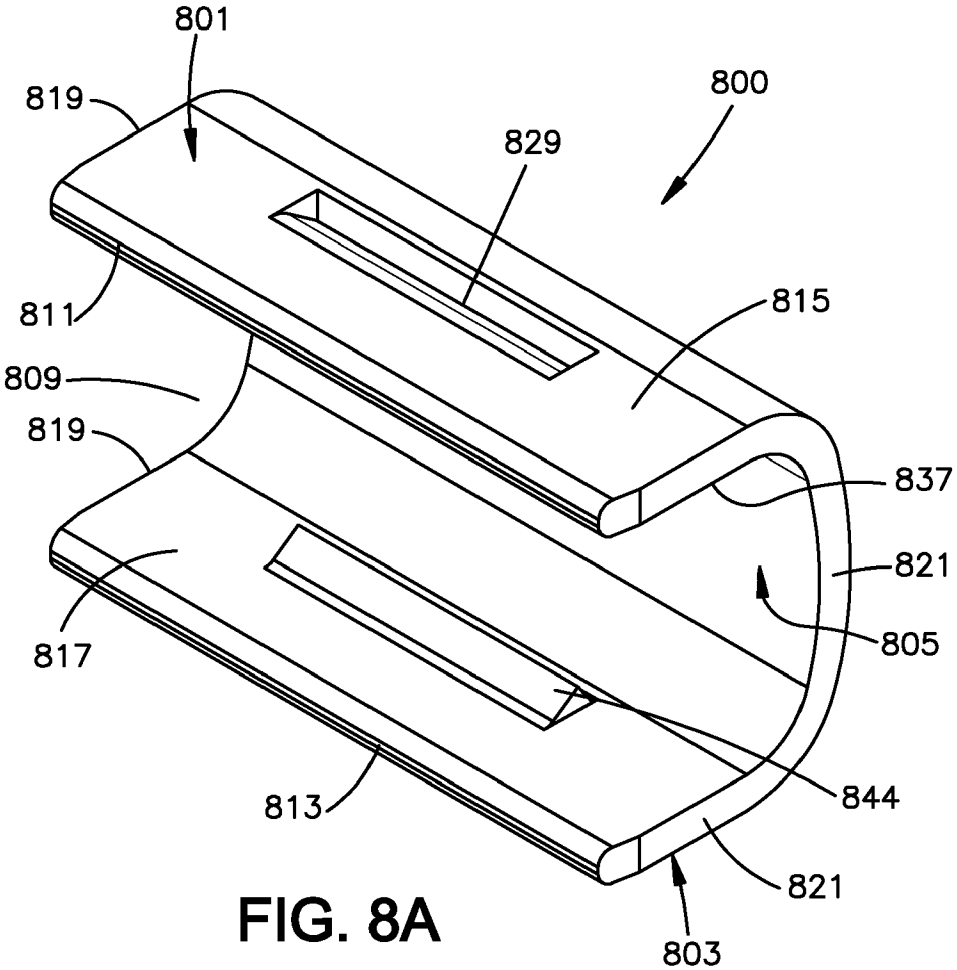
FIG. 8A is a top, front perspective view of another aspect of the retainer.

According to further aspects, as shown in FIGS. 8A and 8B, a retainer 800 may include an upper end portion 801, a bottom or lower end portion 803, and a middle or intermediate portion 805, which connects the upper end portion 801 to the lower end portion 803. The upper end portion 801, the lower end portion 803, and the intermediate portion 805 may collectively define a cavity 809, which may be operable to securely receive the portion of the side edge 105 therein. The retainer 800 may include a first end face, or tip 811, on the upper end portion 801 and a second end face, or tip 813, on the lower end portion 803, with each of the end faces/tips 811, 813 generally facing toward the blades 117, when the retainer 800 is mounted to the cartridge 100. The tips 811, 813 may be substantially rounded, each with a curvature defined by a plurality of radii, for example, between 0.1 millimeters and 0.25 millimeters. According to some aspects, the curvature of the end faces/tips 811, 813 may be, for example, about 0.2 millimeters. Either or both of the tips 811, 813 may be rounded, planar, or a combination thereof with. An outer surface 815 of the retainer 800 may extend entirely between the tips 811, 813 and along the upper end, lower end and intermediate portions 801, 803, 805. On an opposite side of the retainer 800, an inner surface 817 extends entirely between the tips 811, 813 and along the portions 801, 803, 805 to directly abut and substantially surround a portion of the side edge 105 of the housing of the cartridge 100 when the retainer 800 is mounted to the cartridge 100. The retainer 800 may include a rear edge 819 that is adjacent to the cap 115 and a front edge 821 that is adjacent to the guard bar 113 when the retainer 800 is mounted to the cartridge 100. According to some aspects, the retainer 800 may also be designed so that the rear edge 819 is most adjacent to the guard bar 113 and the front edge 821 is most adjacent to the cap. According to some aspects, the edges 819, 821 of the retainer 800 may be coplanar side surfaces of the upper end, lower end and intermediate portions 801, 803, 805. Similar to the retainers 500, 600, 700, the retainer 800 does not include a positioner. The retainer 800 may also include an upper recess 829 and an upper protrusion 831, which may be formed on the surfaces 815, 817 of the upper end portion 801 of the retainer 800, respectively, and may be cooperatively operable to further secure the retainer 800 to the shaving cartridge 100. Unlike the retainers 200, 300, 400, 500, 600, 700, the retainer 800 includes a lower recess 844 and a lower protrusion 846, which may be formed on the surfaces 815, 817 of the lower end portion 803 of the retainer 800, respectively, and may be cooperatively operable to further secure the retainer 800 to the shaving cartridge 100 in coordination with the upper recess 829 and the upper protrusion 831. According to other aspects, the size and shape of the upper recess 829 and the upper protrusion 831 may be equal to the size and shape of the lower recess 844 and the lower protrusion 846, respectively. However, according to some aspects, the sizes and/or shapes of the recesses 829, 844 and/or the protrusions 831, 846 may differ. The upper end portion 801 of the retainer 800 may also include a surface pattern, without any ridges or depressions. The surface pattern of the upper end portion 801 of the retainer 800 may be substantially planar and may include a planar portion 837. In this manner, the planar portion 837 may be operable to abut, position, and retain each of the blades 117 in the shaving cartridge 100 when the retainer 800 is mounted to the cartridge 100. The surface pattern formed in the upper end surface 801 of the retainer 800 may result in the tip 811 having substantially planar upper and lower surfaces.

Figure 9B:
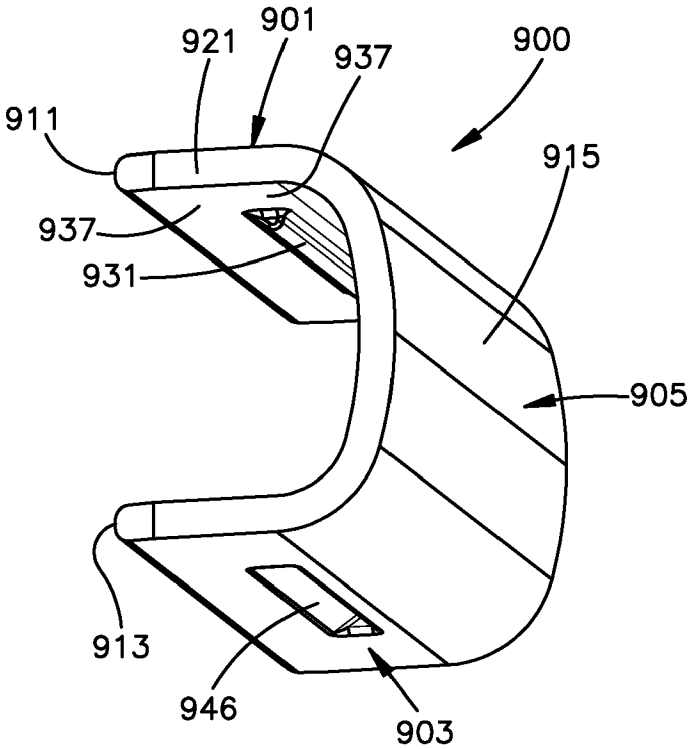
FIG. 9B is a bottom, rear perspective view of the retainer shown in FIG. 9A.
Figure 9A:
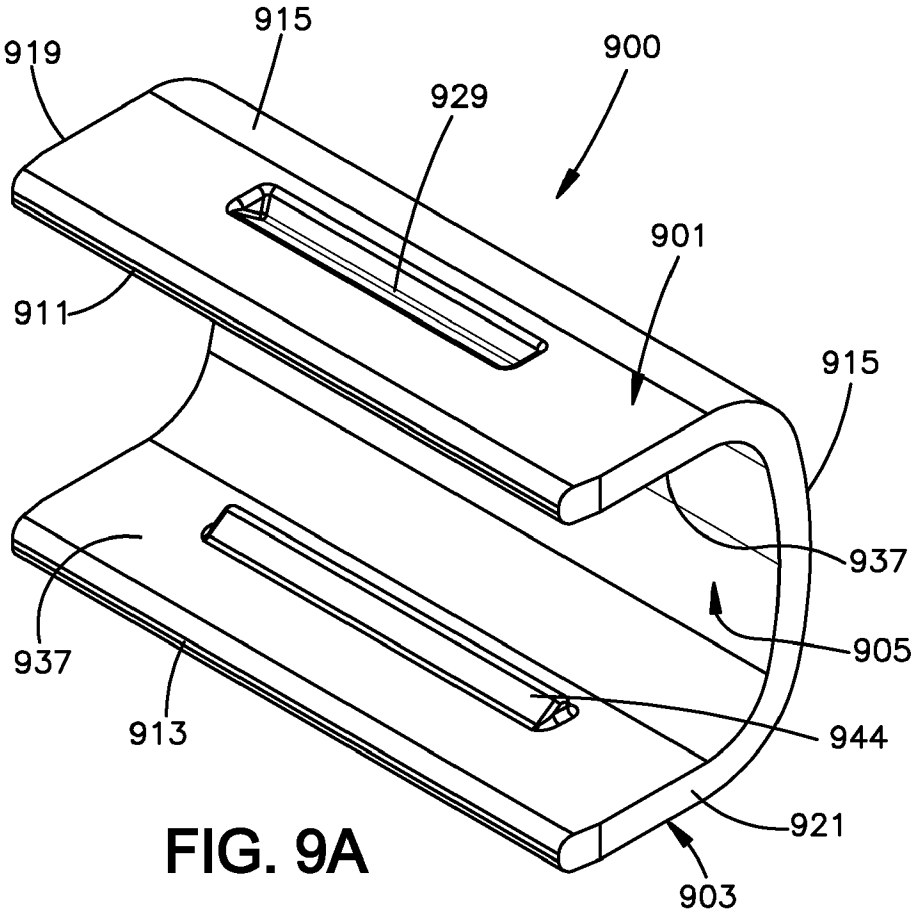
FIG. 9A is a top, front perspective view of another aspect of the retainer.

According to further aspects, as shown in FIGS. 9A and 9B, a retainer 900 may include an upper end portion 901, a bottom or lower end portion 903, and a middle or intermediate portion 905, which connects the upper end portion 901 to the lower end portion 903. The upper end portion 901, the lower end portion 903, and the intermediate portion 905, may collectively, define a cavity 909, which may be operable to securely receive the portion of the side edge 105 therein. The retainer 900 may include a first end face, or tip 911, on the upper end portion 901 and a second end face, or tip 913, on the lower end portion 903, with each of the end faces/tips 911, 913 generally facing toward the blades 117, when the retainer 900 is mounted to the cartridge 100. The end faces/tips 911, 913 may be substantially rounded, each with a curvature defined by a plurality of radii, for example, between 0.1 millimeters and 0.25 millimeters. According to some aspects, the curvature of the end faces 911, 913 may also be, for example, about 0.2 millimeters. Either or both of the end faces 911, 913 may be rounded, planar, or a combination thereof. An outer surface 915 of the retainer 900 extends entirely between the end faces 911, 913 and along the upper end, lower end and intermediate portions 901, 903, 905. On an opposite side of the retainer 900, an inner surface 917 extends entirely between the tips 911, 913 and along the portions 901, 903, 905 to directly abut and substantially surround a portion of the side edge 105 of the housing of the cartridge 100 when the retainer 900 is mounted to the cartridge 100. The retainer 900 may include a rear edge 919 that is adjacent to the cap 115 and a front edge 921 that is adjacent to the guard bar 113 when the retainer 900 is mounted to the cartridge 100. According to some embodiments, the retainer 900 may also be designed so that the rear edge 919 is most adjacent to the guard bar 113 and the front edge 921 is most adjacent to the cap 115. The edges 919, 921 of the retainer 900 may be coplanar side surfaces of the upper end, lower end, and intermediate portions 901, 903, 905. According to further aspects, and, similar to the retainers 500, 600, 700, 800, the retainer 900 does not include a positioner. The retainer 900 may include an upper recess 929 and an upper protrusion 931, which are formed on the surfaces 915, 917 of the upper end portion 901 of the retainer 900, respectively, and may be cooperatively operable to further secure the retainer 900 to the shaving cartridge 100. The retainer 900 may include a lower recess 944 and a lower protrusion 946, which may be formed on the surfaces 915, 917 of the lower end portion 903 of the retainer 900, respectively, and may be cooperatively operable to further secure the retainer 900 to the shaving cartridge 100 in coordination with the upper recess 929 and the upper protrusion 931. The size and shape of the upper recess 929 and the upper protrusion 931 may be equal to the size and shape of the lower recess 944 and the lower protrusion 946, respectively. However, the sizes and/or shapes of the recesses 929, 944 and/or the protrusions 931, 946 may also differ without deviating from the scope of the present disclosure. The upper end portion 901 of the retainer 900 may also include a surface pattern without any ridges or depressions. The surface pattern of the upper end portion 901 of the retainer 900 may be substantially planar and may include a planar portion 937. In this manner, the planar portion 937 may be operable to abut, position, and retain each of the blades 117 in the shaving cartridge 100 when the retainer 900 is mounted to the cartridge 100. The surface pattern formed in the upper end surface 901 of the retainer 900 may result in the tip 911 having substantially planar upper and lower surfaces.

Figure 10B:
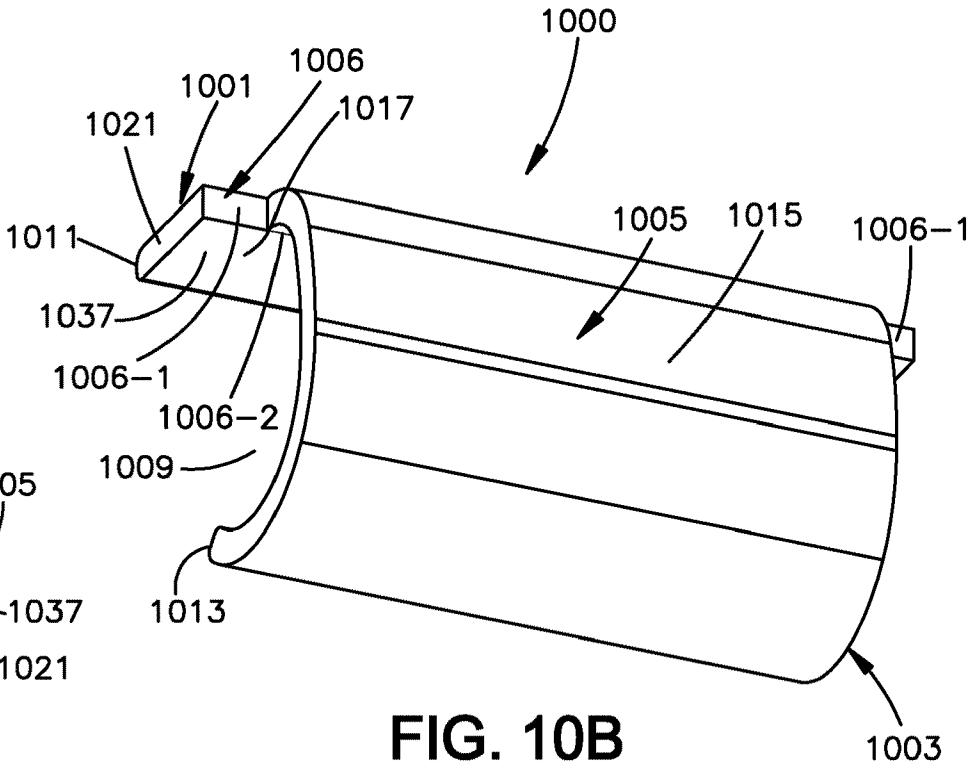
FIG. 10B is a bottom, rear perspective view of the retainer shown in FIG. 10A.
Figure 10A:
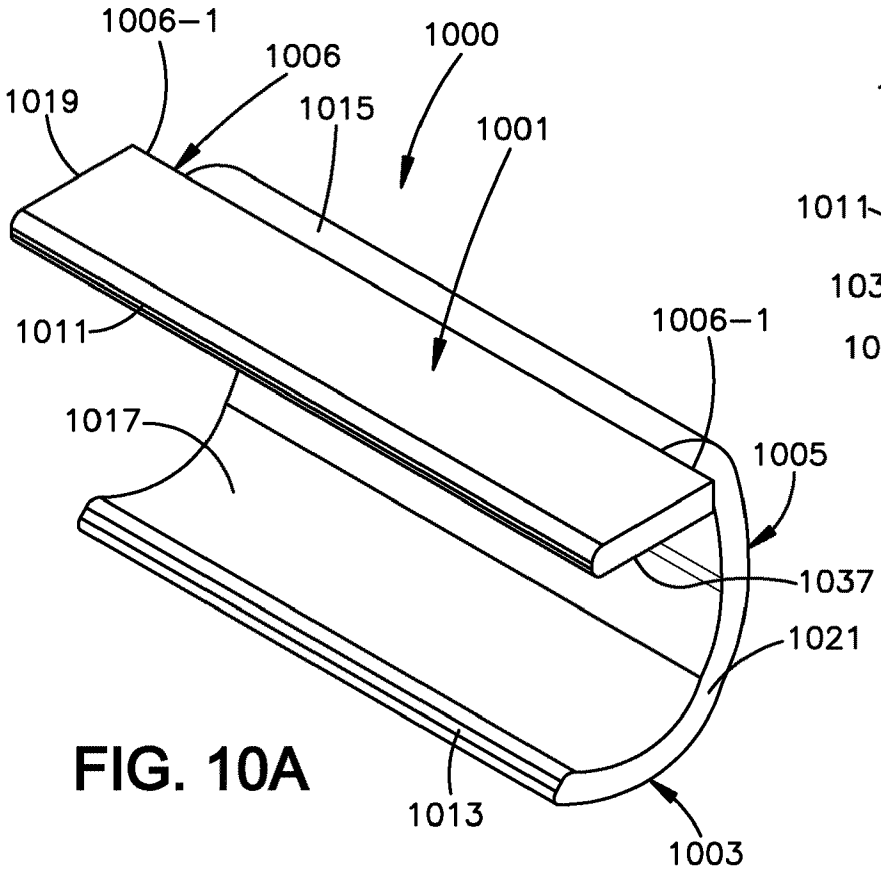
FIG. 10A is a top, front perspective view of another aspect of the retainer.

According to some aspects, as shown in FIGS. 10A and 10B, a retainer 1000, similar to the retainer 500, may include an upper end portion 1001, but includes a leg 1002 having a bottom or lower end portion 1003, and a middle or intermediate portion 1005. The leg 1002 may depend from only a portion of an edge 1006 of the upper end portion 1001. In this manner, the leg 1002 may cause an exposed portion 1006-1 of the edge 1006 to be exposed by the leg 1002, and a concealed portion 1006-2 of the edge 1006 to be concealed by the leg 1002. According to some aspects, the leg 1002 may be integrally formed with the upper end portion 1001. However, the leg 1002 may also be manufactured separately from the upper end portion 1001 and secured thereto during manufacturing of the retainer 1000, such as, for example by welding, glue, or other attachment means. The intermediate portion 1005 connects the upper end portion 1001 to the lower end portion 1003. The upper end portion 1001, the lower end portion 1003, and the intermediate portion 1005 may collectively define a cavity 1009, which may be operable to securely receive the portion of the side edge 105 therein. The retainer 1000 may include a first end face, or tip 1011, on the upper end portion 1001 and a second end face, or tip 1013, on the lower end portion 1003, with each of the tips 1011, 1013 generally facing toward the blades 117, when the retainer 1000 is mounted to the cartridge 100. The end faces 1011, 1013 may be substantially rounded, each with a curvature defined by a plurality of radii, for example, between 0.1 millimeters and 0.25 millimeters. According to some aspects, the curvature of the end faces 1011, 1013 may be, for example, between 0.15 millimeters and 0.2 millimeters. Either or both of the tips 1011, 1013 may be rounded, planar, or a combination thereof. An outer surface 1015 of the retainer 1000 may extend entirely between the end faces 1011, 1013 and along the upper end, lower end and intermediate portions 1001, 1003, 1005. On an opposite side of the retainer 1000, an inner surface 1017 extends entirely between the tips 1011, 1013 and along the portions 1001, 1003, 1005 to directly abut and substantially surround a portion of the side edge 105 of the housing of the cartridge 100 when the retainer 1000 is mounted to the cartridge 100. The upper end surface 1001 of the retainer 1000 may include a rear edge 1019 that is adjacent to the cap 115 and a front edge 1021 that is adjacent to the guard bar 113 when the retainer 1000 is mounted to the cartridge 100. The retainer 1000 may also be designed so that the rear edge 1019 is most adjacent to the guard bar 113 and the front edge 1021 is most adjacent to the cap 115. According to some aspects, edges 1019, 1021 of the upper end surface 1001 of the retainer 1000 are not coplanar to side surfaces of the lower end and intermediate portions 1003, 1005. Similar to the retainer 500, the retainer 1000 does not include a positioner. Unlike the retainers 200, 300, 400, 500, the retainer 1000 does not include any recesses or any protrusions. The upper end portion 1001 of the retainer 1000 also includes a surface pattern without any ridges or depressions. The surface pattern of the upper end portion 1001 of the retainer 1000 may be substantially planar and may include a planar portion 1037. In this manner, the planar portion 1037 may be operable to abut, position, and retain each of the blades 117 in the shaving cartridge 100, when the retainer 1000 is mounted to the cartridge 100. The surface pattern formed in the upper end surface 1001 of the retainer 1000 may result in the end face 1011 having substantially planar upper and lower surfaces. Similar to the retainer 500, the reduced sizes of the intermediate portion 1007 and the lower end portion 1009 of the leg 1002 may advantageously provide increased resilience of the leg 1002, which may facilitate assembly of the shaving cartridge 100 using the retainer 1000. Likewise, the reduced sizes of the intermediate portion 1007 and the lower end portion 1009 may advantageously provide increased exposure of and access to the pair of side edges 105 while reducing material consumption and manufacturing costs. According to some aspects, the increased exposure of the side edges 105 may allow a user to view an additional component such as a visual usage indicator. According to further aspects, at least a portion of the retainer 1000 may be be made of a transparent material to allow a user to view an additional component such as the visual usage indicator. The component may be positioned on one or both of the side edges 105 and adjacent to the blades 117. The component may be operable to communicate a status of the cartridge 100 to the user based on one or more other components of the cartridge 100, for example, whether the cartridge 100 is new and functional, used and partially functional, and/or depleted and non-functional.

Figure 11B:
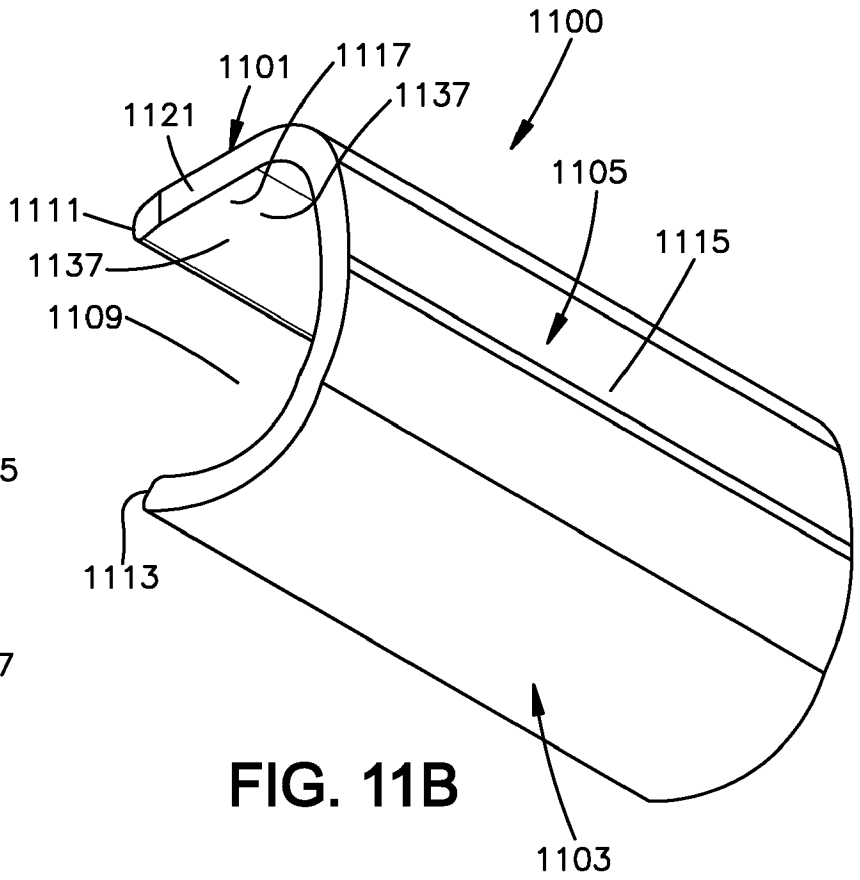
FIG. 11B is a bottom, rear perspective view of the retainer shown in FIG. 11A.
Figure 11A:
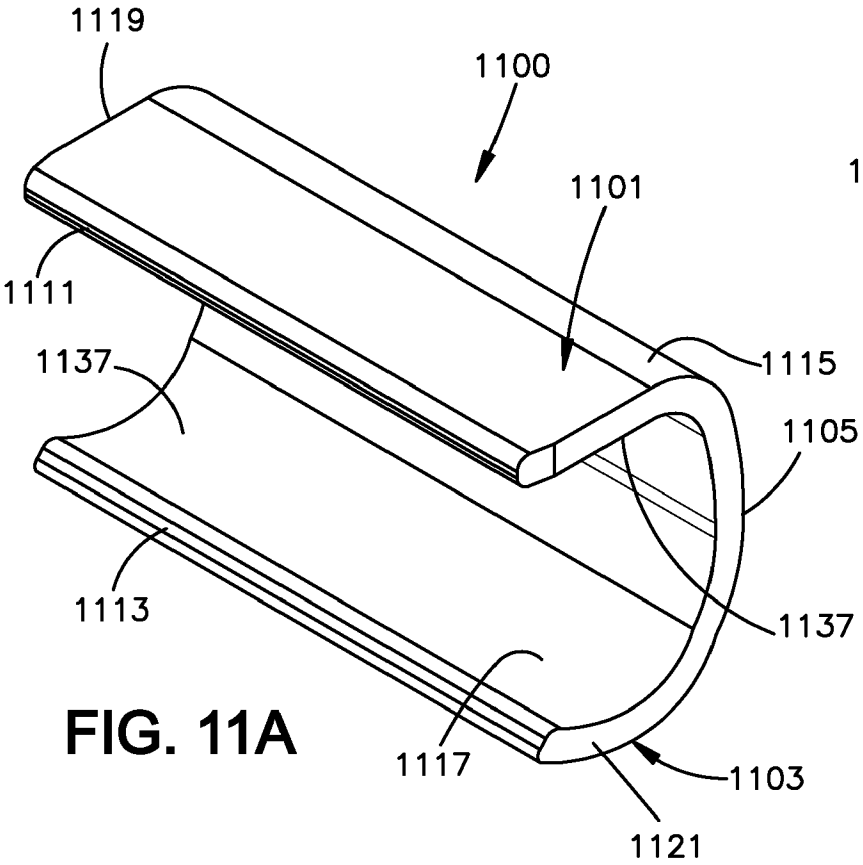
FIG. 11A is a top, front perspective view of another aspect of the retainer.

According to some aspects, as shown in FIGS. 11A and 11B, a retainer 1100 including an upper end portion 1101, a bottom or lower end portion 1103, and a middle or intermediate portion 1105, which connects the upper end portion 1101 to the lower end portion 1103. The upper end portion 1101, the lower end portion 1103, and the intermediate portion 1105 may collectively define a cavity 1109, which may be operable to securely receive the portion of the side edge 105 therein. The retainer 1100 may include a first end face, or tip 1111, on the upper end portion 1101 and a second end face, or tip 1113, on the lower end portion 1103, with each of the tips 1111, 1113 generally facing toward the blades 117, when the retainer 1100 is mounted to the cartridge 100. The end faces 1111, 1113 may be substantially rounded, each with a curvature defined by a plurality of radii, for example, between 0.1 millimeters and 0.25 millimeters. According to other aspects, the curvature of the end faces 1111, 1113 may be, for example, between 0.15 millimeters and 0.2 millimeters. Either or both of the tips 1111, 1113 may be rounded, planar, or a combination thereof. An outer surface 1115 of the retainer 1100 may extend entirely between the end faces 1111, 1113 and along the upper end, lower end and intermediate portions 1101, 1103, 1105. On an opposite side of the retainer 1100, an inner surface 1117 extends entirely between the end faces 1111, 1113 and along the upper end, lower end, and intermediate portions 1101, 1103, 1105 to directly abut and substantially surround a portion of the side edge 105 of the housing of the cartridge 100 when the retainer 1100 is mounted to the cartridge 100. The retainer 900 may include a rear edge 1119 that is adjacent to the cap 115 and a front edge 1121 that is adjacent to the guard bar 113 when the retainer 1100 is mounted to the cartridge 100. The retainer 1100 may also be designed so that the rear edge 1119 is most adjacent to the guard bar 113 and the front edge 1121 is most adjacent to the cap 115. According to some aspects, the edges 1119, 1121 of the retainer 1100 may be coplanar side surfaces of the upper end, lower end and intermediate portions 1101, 1103, 1105. Also, similar to the retainers 500, 600, 700, 800, 900, the retainer 1100 does not include a positioner. Additionally, the retainer 1000, the retainer 1100 does not include any recesses or any protrusions. Similar to the retainers 400, 500, 600, 700, 800, 900, 1000, the upper end portion 1101 of the retainer 1100 may include a surface pattern without any ridges or depressions. The surface pattern of the upper end portion 1101 of the retainer 1100 may be substantially planar and may include a planar portion 1137. In this manner, the planar portion 1137 may be operable to abut, position, and retain each of the blades 117 in the shaving cartridge 100 when the retainer 1100 is mounted to the cartridge 100. The surface pattern may be formed in the upper end surface 1101 of the retainer 1100 results in the end face 1111 having substantially planar upper and lower surfaces.

It will be appreciated by those skilled in the art that changes could be made to the embodiments described above without departing from the broadened concepts concept thereof. It is understood, therefore, that the concepts disclosed herein is not limited to the particular embodiments disclosed, and is intended to cover modifications within the spirit and scope of the present disclosure.

One of skill in the art will recognize that the described examples are not limited to any particular size. Further, one of skill in the art will recognize that the components of the retainer 200 are not limited to any type of material. In a preferred example, the retainer, for example, any one or more of the retainers 200, 300, 400, 500, 600, 700, 800, 900, 1000, 1100, is formed of a metal material, but may be formed of a variety of different materials including plastic or the like, or a combination thereof. One skilled in the art will recognize that different diameters, types, and thicknesses of preferred materials can be utilized when taking into consideration design and stability considerations. A number of manufacturing techniques may be used such as the machining, molding, or casting one or more components of the retainer. An example process of manufacturing the retainer includes use of a punch and die metal-forming process to form various components of the retainer. For example, a plurality of protrusions, for example, the plurality of protrusions 231, and a plurality of recesses, e.g., the plurality of recesses 229, may be formed via such a process, whereby a die shaped like the plurality of protrusions is oriented on an inner surface, for example, the inner surface 217 of the retainer 200, with adequate offset needs for stamping. An outer surface, e.g., the outer surface 215, of an upper end portion, is punched, which results in simultaneous formation of the plurality of recesses on the outer surface and the plurality of protrusions on the inner surface due to a transfer of material of the retainer. Each of the protrusions is caused to extend from the inner surface of the upper end portion and assume the shape of the die. Other components that can be formed using a punch and die metal-forming process include a plurality of ridges, a plurality of depressions, and/or a positioner. For instance, a die shaped like the plurality of ridges 245 may be oriented on the inner surface 217 of the retainer 200 with adequate offset needs for stamping. The outer surface 215 of the upper end portion 201 is punched, which results in simultaneous formation of the plurality of depressions 259 on the outer surface 215 and the plurality of ridges 245 on the inner surface 217 due to a transfer of material of the retainer 200. The plurality of ridges 245 is caused to extend from the inner surface 217 of the upper end portion 201 and assume the shape of the die. Use of a punch and die metal-forming process to form various components advantageously provides for high-volume replication with high precision and accuracy in positioning the various components on the retainer and ultimately with respect to the blades 117. Alternatively, if other materials are used to form the retainer, e.g., plastic, the various components of the retainer can be produced via an injection molding process or other like manufacturing means.

It will be appreciated by those skilled in the art that changes could be made to the embodiments described above without departing from the broad inventive concept thereof. It is understood, therefore, that the present invention disclosed herein is not limited to the particular embodiments disclosed, and is intended to cover modifications within the spirit and scope of the present disclosure.

The invention claimed is:

1. A shaving blade unit comprising:

a housing having a front edge, a rear edge, a side edge extending between the front edge and the rear edge;

a plurality of shaving blades received in the housing;

a retainer securing the plurality of blades in the housing, the retainer including:

an upper end portion and at least one leg;

the upper end portion including an upper surface and an opposing lower surface, and front and rear edges extending longitudinally between a pair of opposing parallel side edges, the lower surface extending from the front edge;

the at least one leg depending from the rear edge of the upper end portion, extending substantially transverse to the upper end portion, and being positioned to expose at least a portion of the rear edge;

the at least one leg including a lower end portion that curves upwardly and extends towards the lower surface of the upper end portion, the lower surface forming a protrusion a distance away from the front edge, the protrusion extending downwardly and towards the lower end portion; and the upper end portion abutting the plurality of blades to retain the plurality of blades in the housing.

2. The shaving blade unit of claim 1, wherein the at least one leg includes a plurality of legs depending from the rear edge of the upper end portion, each of the plurality of legs being positioned to expose the at least one portion of the rear edge and including lower end portions that curve upwardly and extend towards the lower surface of the upper end portion.

3. The shaving blade unit of claim 2, wherein each of the plurality of legs is curved toward the upper end portion to define a cavity that is partially enclosed by the plurality of legs and the upper end portion.

4. The shaving blade unit of claim 3, wherein the retainer further includes a recess formed on the upper end portion and extending inwardly and toward the lower end portion.

5. The shaving blade unit of claim 1 wherein the protrusion extends entirely between the pair of opposing parallel side edges of the upper end portion, and another portion of the rear edge is concealed by at least one of the plurality of legs.

6. The of shaving blade unit of claim 1, wherein the at least one leg is curved toward the upper end portion to define a cavity that is partially enclosed by the at least one leg and the upper end portion.

7. The shaving blade unit of claim 1, wherein the front edge is rounded.

8. The shaving blade unit of claim 1, wherein at least a portion of the lower surface is operable to abut the plurality of blades to secure the plurality of blades in the shaving blade unit.

9. The shaving blade unit of claim 1, wherein the upper end portion is substantially planar.

10. The shaving blade unit of claim 1, wherein the upper end portion and the at least one leg directly abut and substantially surround at least a portion of the side edge of the housing.

* * * * *